US010916211B2

(12) United States Patent
Nagashima

(10) Patent No.: US 10,916,211 B2
(45) Date of Patent: Feb. 9, 2021

(54) METHOD FOR CORRECTING LUMINANCE NON-UNIFORMITY IN LIQUID CRYSTAL DISPLAY APPARATUS, AND CORRECTION DATA GENERATION DEVICE

(71) Applicant: SAKAI DISPLAY PRODUCTS CORPORATION, Sakai (JP)

(72) Inventor: Nobuyoshi Nagashima, Sakai (JP)

(73) Assignee: SAKAI DISPLAY PRODUCTS CORPORATION, Sakai (JP)

( * ) Notice: Subject to any disclaimer, the term of this patent is extended or adjusted under 35 U.S.C. 154(b) by 21 days.

(21) Appl. No.: 16/336,032

(22) PCT Filed: Sep. 27, 2016

(86) PCT No.: PCT/JP2016/078502
§ 371 (c)(1),
(2) Date: Apr. 1, 2020

(87) PCT Pub. No.: WO2018/061093
PCT Pub. Date: Apr. 5, 2018

(65) Prior Publication Data

US 2020/0335054 A1 Oct. 22, 2020

(51) Int. Cl.
*G09G 3/36* (2006.01)

(52) U.S. Cl.
CPC ..... *G09G 3/3655* (2013.01); *G09G 3/3688* (2013.01); *G09G 2310/027* (2013.01); *G09G 2320/0233* (2013.01)

(58) Field of Classification Search
CPC ..... G09G 3/3233; G09G 3/3426; G09G 2320/0233; G09G 2320/043;
(Continued)

(56) References Cited

U.S. PATENT DOCUMENTS

2006/0145986 A1 7/2006 Oh et al.
2008/0238934 A1 10/2008 Daly et al.
(Continued)

FOREIGN PATENT DOCUMENTS

JP 2006-189869 A 7/2006
JP 2008-250319 A 10/2008
(Continued)

OTHER PUBLICATIONS

International Search Report of PCT/JP2016/078502.

*Primary Examiner* — Dong Hui Liang
(74) *Attorney, Agent, or Firm* — ScienBiziP, P.C.

(57) ABSTRACT

Provided are a method for correcting luminance nonuniformity of a liquid crystal display apparatus and a correction data generation device. Included are setting a voltage of a counter electrode to a specific counter voltage and capturing an image of a display screen; capturing each image of the display screen while increasing and decreasing the voltage of the counter electrode by a predetermined voltage; detecting a luminance value for each of a plurality of regions of the display screen each time an image is captured; determining a correction voltage for each of the region, for correcting a deviation of the counter voltage, based on a luminance value detected without varying a voltage of the counter electrode and luminance values each detected while increasing and decreasing a voltage of the counter electrode and superimposing a determined correction voltage on the data signal having an amplitude corresponding to a grayscale value.

8 Claims, 14 Drawing Sheets

(58) Field of Classification Search
CPC ... G09G 2320/0285; G09G 2320/0626; G09G 2320/045; G09G 2320/0693; G09G 2320/0295; G09G 2320/0242; G09G 2320/0646; G09G 2320/0223; G09G 2320/041; G09G 2320/0673; G09G 2300/0819; G09G 2300/0842; G09G 2300/0866; G09G 5/10
See application file for complete search history.

(56) References Cited

U.S. PATENT DOCUMENTS

| | | | | |
|---|---|---|---|---|
| 2011/0122114 | A1 | 5/2011 | Tanaka et al. | |
| 2011/0221760 | A1 | 9/2011 | Irie et al. | |
| 2011/0285763 | A1* | 11/2011 | Bassi | G09G 3/2003 345/694 |
| 2013/0135279 | A1* | 5/2013 | Pui | G09G 3/344 345/211 |
| 2015/0062471 | A1* | 3/2015 | Sung | G02F 1/1362 349/33 |
| 2016/0140919 | A1* | 5/2016 | Yim | G09G 3/3648 345/89 |
| 2017/0092177 | A1* | 3/2017 | Kobayashi | G06F 1/1637 |

FOREIGN PATENT DOCUMENTS

| | | | |
|---|---|---|---|
| JP | 2011-112865 | A | 6/2011 |
| JP | 2015-087529 | A | 5/2015 |
| WO | 2010/073775 | A1 | 7/2010 |

* cited by examiner

METHOD FOR CORRECTING LUMINANCE NON-UNIFORMITY IN LIQUID CRYSTAL DISPLAY APPARATUS, AND CORRECTION DATA GENERATION DEVICE

TECHNICAL FIELD

The present invention relates to a display apparatus, and more particularly relates to a method for correcting luminance nonuniformity on a display screen of a liquid crystal display apparatus and a correction data generation device.

BACKGROUND ART

Liquid crystal display apparatus is a flat panel display apparatus having excellent features such as high definition, thin shape, light weight, and low power consumption, and is widely used for thin television sets, personal computer monitors, digital signages and the like. On the display screen of a liquid crystal display apparatus, there is some amount of luminance nonuniformity that can be visually recognized by persons, although the degree thereof may differ. The luminance nonuniformity caused by so-called nonuniformity defects appears in various forms, and there is a wide range of factors that cause nonuniformity defects.

For example, Patent document 1 discloses a method for directly reducing nonuniformity defects by allocating at least one gray level to a plurality of pixels of a display apparatus, irradiating each pixel according to the gray level, and correcting a grayscale value for the pixel to reduce nonuniformity defects on the display apparatus that can be visually recognized by a human viewing angle system.

In order to prevent the liquid crystal from deteriorating, signals each different in polarity with respect to the voltage of a counter electrode are alternately provided to each pixel via a switching element such as a thin film transistor (TFT). In this case, since there are variations in magnitude in liquid crystal capacitance of each pixel and parasitic capacitance of the switching element, it is known that a difference occurs in so-called pull-in voltage and variation occurs in counter voltage optimum for each pixel. For this reason, a deviation occurs in luminance change characteristics with respect to voltage of a signal provided to each pixel and gamma characteristics cannot be uniformly corrected. Therefore, there was a case having caused a problem by directly applying the technique described in the patent document 1 for reducing nonuniformity defects.

On the other hand, Patent document 2 discloses a defect inspection device and a defect inspection method for detecting a nonuniformity defective portion by utilizing a luminance relationship between a normal portion and the nonuniformity defective portion, which relatively varies depending on a high/low level of the voltage of a counter electrode. This technique utilizes the fact that the luminance of the pixel changes to be larger when the counter voltage is shifted in plus and minus directions with respect to the counter voltage optimum for each pixel, and that the luminance change characteristics with respect to the counter voltage can be expressed by an even function.

PRIOR ART DOCUMENT

Patent document 1: JP2008-250319 A

Patent document 2: JP2015-87529 A

SUMMARY OF THE INVENTION

Problem to be Solved by the Invention

However, the technique described in Patent document 2 is the one for merely detecting a nonuniformity defective portion and not the one for positively correcting nonuniformity defects.

The present invention has been made in view of such circumstances and intends to provide a luminance nonuniformity correction method for a liquid crystal display apparatus and a correction data generation device, which can correct the luminance nonuniformity even when the optimum counter voltage varies depending on a region of the display screen.

Means to Solve the Problem

A luminance nonuniformity correction method for a liquid crystal display apparatus according to one embodiment of the present invention is a method for correcting luminance nonuniformity occurring on a display screen of a liquid crystal display apparatus in which pixels each being defined so as to include a pixel electrode and a counter electrode facing each other via a liquid crystal layer are arranged in a matrix form and a data signal having an amplitude corresponding to a grayscale value from the outside is applied to a switching element to provide a signal to the pixel electrode, including: preparing an imaging unit configured to capture an image of the display screen; setting an amplitude of the data signal to an amplitude corresponding to a predetermined grayscale value; setting a voltage of the counter electrode to a specific counter voltage; capturing an image of the display screen with the imaging unit; capturing each image of the display screen with the imaging unit while increasing and decreasing a voltage of the counter electrode, respectively, by a predetermined voltage; detecting a luminance value for each of a plurality of regions of the display screen each time an image is captured; determining a correction voltage for each of the regions, for correcting a deviation between a voltage of the counter electrode to be set for the signal provided to the pixel electrode and the counter voltage, based on a luminance value detected without increasing and decreasing a voltage of the counter electrode and luminance values each detected while increasing and decreasing a voltage of the counter electrode, respectively; and superimposing a determined correction voltage on the data signal having an amplitude corresponding to a grayscale value from the outside.

A correction data generation device according to one embodiment of the present invention is a correction data generation device to generate correction data for correcting luminance nonuniformity occurring on a display screen of a liquid crystal display apparatus in which pixels each being defined so as to include a pixel electrode and a counter electrode facing each other via a liquid crystal layer are arranged in a matrix form and a data signal having an amplitude corresponding to a grayscale value from the outside is applied to a switching element to provide a signal to the pixel electrode, including: a first acquisition unit configured to acquire imaging data capturing an image of the display screen when the grayscale value is a predetermined grayscale value and a voltage of the counter electrode is a specific counter voltage; second and third acquisition units configured to acquire imaging data capturing an image of the display screen when a voltage of the counter electrode increases and decreases from the counter voltage by a predetermined voltage, respectively; a detection unit configured to detect a luminance value for each of a plurality of regions of the display screen based on imaging data acquired by the first, second, and third acquisition units, respectively; and a generation unit configured to generate correction data for each of the region, the correction data indicating a correction voltage for correcting a deviation between a voltage of the counter electrode to be set for the signal provided to the pixel electrode and the counter voltage, based on a luminance value detected by the detection unit based on imaging data acquired by the first acquisition unit and a luminance value detected by the detection unit based on imaging data acquired by the second and third acquisition units, respectively.

Effects of the Invention

According to the above-mentioned contents, it is possible to correct luminance nonuniformity even when the optimum counter voltage varies depending on a region of the display screen.

BRIEF DESCRIPTION OF THE DRAWINGS

FIG. 100 is an explanatory diagram for explaining the luminance when further varying the voltage of the counter electrode by a certain value in the state where the voltage of the counter electrode deviates to the minus side.

EMBODIMENT FOR CARRYING OUT THE INVENTION

Figure 1:
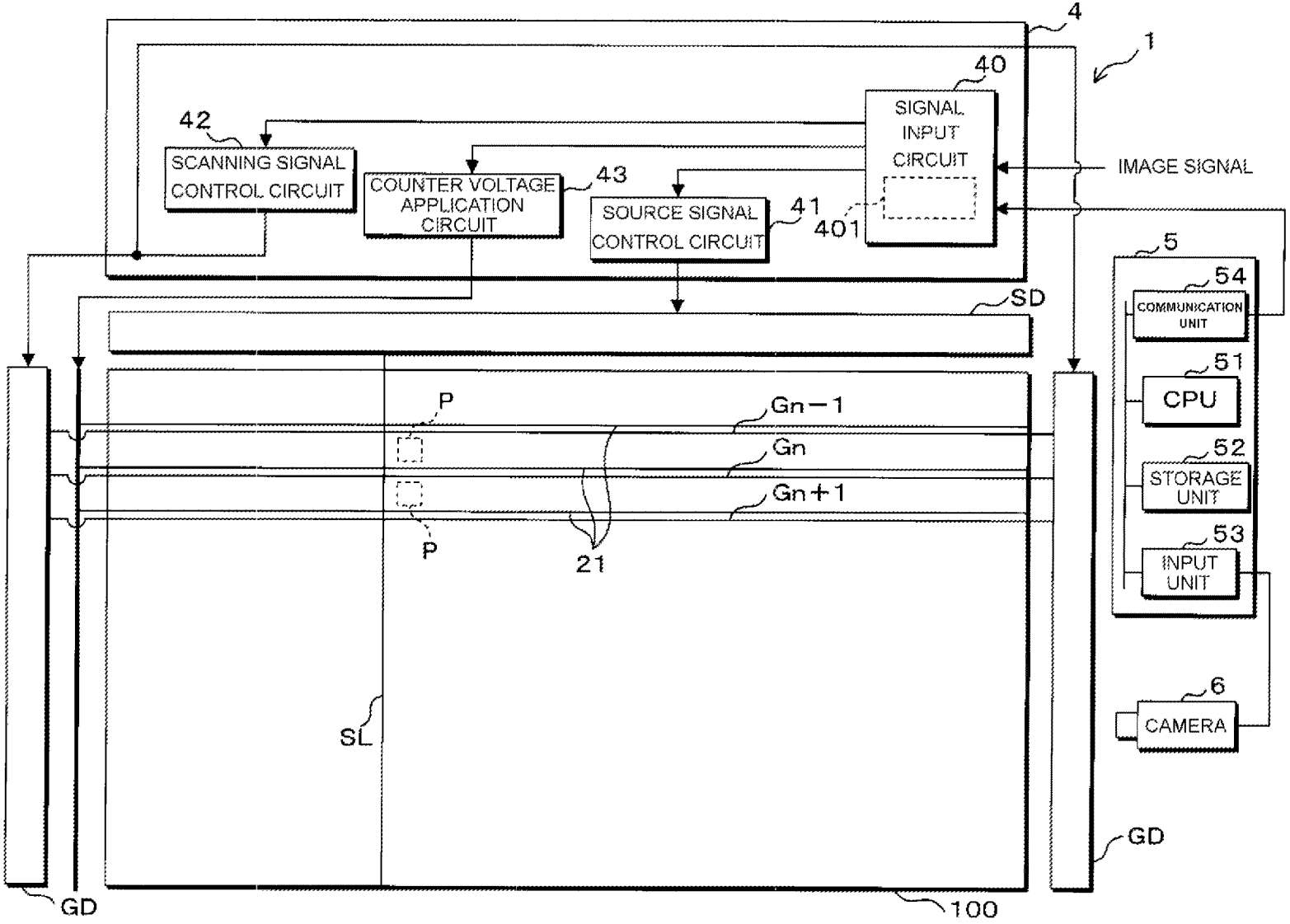
FIG. 1 is a block diagram showing a configuration example of a liquid crystal display apparatus to which a correction data generation device according to an embodiment of the present invention is connected.

Description of Embodiments of the Present Invention

First, embodiments of the present invention will be listed and described. Further, at least a part of an embodiment described below may be arbitrarily combined with others.

(1) A luminance nonuniformity correction method for a liquid crystal display apparatus according to one aspect of the present invention is a method for correcting luminance nonuniformity occurring on a display screen of a liquid crystal display apparatus in which pixels each being defined so as to include a pixel electrode and a counter electrode facing each other via a liquid crystal layer are arranged in a matrix form and a data signal having an amplitude corresponding to a grayscale value from the outside is applied to a switching element to provide a signal to the pixel electrode, including: preparing an imaging unit configured to capture an image of the display screen; setting an amplitude of the data signal to an amplitude corresponding to a predetermined grayscale value; setting a voltage of the counter electrode to a specific counter voltage; capturing an image of the display screen with the imaging unit; capturing each image of the display screen with the imaging unit while increasing and decreasing a voltage of the counter electrode, respectively, by a predetermined voltage; detecting a luminance value for each of a plurality of regions of the display screen each time an image is captured; determining a correction voltage for each of the regions, for correcting a deviation between a voltage of the counter electrode to be set for the signal provided to the pixel electrode and the counter voltage, based on a luminance value detected without increasing and decreasing a voltage of the counter electrode and luminance values each detected while increasing and decreasing a voltage of the counter electrode, respectively; and superimposing a determined correction voltage on the data signal having an amplitude corresponding to a grayscale value from the outside.

In this embodiment, the liquid crystal display apparatus to be subjected to luminance nonuniformity correction includes the pixels arranged in a matrix form and defined so as to include the electrode pair of the pixel electrode and the counter electrode facing each other via the liquid crystal layer. By applying the data signal having the amplitude corresponding to the grayscale value from the outside to the switching element dedicated to each pixel, the pixel signal is provided to the pixel electrode, thereby causing the display screen to display an image. In the luminance nonuniformity correction, in a state where the amplitude of the data signal is set to the amplitude corresponding to the predetermined grayscale value and the voltage of the counter electrode is set to the specific counter voltage, an image of the display screen is captured and the luminance value for each region is detected. Further, the voltage of the counter electrode is varied from the specific counter voltage by a predetermined voltage in up and down directions, and an image of the display screen is captured and the luminance value for each region is detected each time the counter electrode voltage is varied. Then, based on the luminance value detected when the voltage of the counter electrode is the specific counter voltage and the luminance values each detected when the voltage of the counter electrode is varied from the specific counter voltage in up and down directions respectively, the correction voltage for correcting the deviation between the voltage of the counter electrode to be originally set and the specific counter voltage being actually set is determined for each region. The determined correction voltage is superimposed on the data signal corresponding to the grayscale value. Accordingly, for a region where there is a deviation between the voltage of the counter electrode to be set for the signal written to the pixel electrode in each region and the specific counter voltage, a correction voltage that can cancel out the deviation can be superimposed on the data signal.

(2) A luminance nonuniformity correction method for a liquid crystal display apparatus according to one aspect of the present invention is characterized by comparing luminance values each detected while increasing and decreasing a voltage of the counter electrode, respectively; and determining a polarity of the correction voltage based on a comparison result.

In this embodiment, based on the magnitude relationship between the luminance values each detected when varying the voltage of the counter electrode from the specific counter voltage by the predetermined voltage in up and down directions respectively, the polarity of the correction voltage is determined. That is, by detecting the direction of the deviation between the voltage of the counter electrode to be originally set and the specific counter voltage, the polarity of the correction voltage that can cancel out the deviation can be determined.

(3) A luminance nonuniformity correction method for a liquid crystal display apparatus according to one aspect of the present invention is characterized by calculating a change amount of any one of luminance values each detected while increasing and decreasing a voltage of the counter electrode, respectively, with respect to a luminance value detected without increasing and decreasing the voltage of the counter electrode; and determining a magnitude of the correction voltage based on a calculation result.

In this embodiment, the magnitude of the correction voltage for correcting the deviation in the voltage of the counter electrode is determined depending on the change amount of any one of the luminance values each detected when varying the voltage of the counter electrode in up and down directions respectively with respect to the luminance value detected when the voltage of the counter electrode is the specific counter voltage. Accordingly, since the polarity and the magnitude of the correction voltage are determined, the correction voltage can be uniquely determined.

(4) A luminance nonuniformity correction method for a liquid crystal display apparatus according to one aspect of the present invention is characterized by preparing a first storage unit; storing information in the first storage unit in advance, the information indicating a relationship between an amount of the deviation and an amount of a variation in a luminance value of the pixel when varying a voltage of the counter electrode from the counter voltage by a predetermined voltage; and determining a magnitude of the correction voltage based on the change amount and the information stored in the first storage unit.

In this embodiment, the information indicating the relationship between the amount of the deviation of the specific counter voltage being actually set with respect to the voltage of the counter electrode to be originally set and the variation in the luminance value of the pixel when varying the voltage of the counter electrode from the specific counter voltage by the predetermined voltage are stored. By collating the change amount of the luminance value detected when varying the voltage of the counter electrode from the specific counter voltage in either up or down direction with respect to the luminance detected when the voltage of the counter electrode is the specific counter voltage with the stored information, the magnitude of the deviation in the voltage of the counter electrode is detected. Accordingly, the magnitude of the correction voltage that can cancel out the deviation can be easily determined.

(5) A luminance nonuniformity correction method for a liquid crystal display apparatus according to one aspect of the present invention is characterized in that one or more pixels are included in the region, and a luminance value of a region in which a plurality of pixels is included is an average luminance value of the plurality of pixels.

In this embodiment, one or more pixels are included in each region. When one pixel is included in the region, the luminance value of the pixel is the luminance value of the region. When a plurality of pixels is included in the region, the average luminance value of the plurality of pixels is the luminance value of the region. Accordingly, the range of a region in which the correction voltage is superimposed on the data signal can be arbitrarily set.

(6) A luminance nonuniformity correction method for a liquid crystal display apparatus according to one aspect of the present invention is characterized in that the counter voltage is an intermediate voltage between the highest voltage and the lowest voltage among intermediate voltages of signals each provided to a pixel electrode of a pixel included in each of the regions.

In this embodiment, among the intermediate voltages of the signals which are written to the pixel electrodes in each of the regions, the intermediate voltage between the highest and the lowest voltage of all the regions is set as the specific counter voltage. Accordingly, when varying the voltage of the counter electrode by the predetermined voltage in up and down directions with the specific counter voltage as the center, the possibility that the luminance value of each region varies beyond a minimal value becomes higher, and an error included in the magnitude of the correction voltage can be reduced.

(7) A luminance nonuniformity correction method for a liquid crystal display apparatus according to one aspect of the present invention is characterized by preparing a second storage unit; storing a correction voltage determined in advance for each region in the second storage unit in association with the region; reading out a correction voltage for each region from the second storage unit; and superimposing a readout correction voltage on the data signal having an amplitude corresponding to a grayscale value from the outside.

In this embodiment, the correction voltage being determined in advance for each region is stored in association with the region in the second storage unit. The correction voltage for each region is read from the second storage unit and superimposed on the data signal in each region. Accordingly, even when there is no imaging unit, the deviation in the voltage of the counter electrode can be corrected for each region by the liquid crystal display apparatus alone.

(8) A correction data generation device according to one aspect of the present invention is a correction data generation device to generate correction data for correcting luminance nonuniformity occurring on a display screen of a liquid crystal display apparatus in which pixels each being defined so as to include a pixel electrode and a counter electrode facing each other via a liquid crystal layer are arranged in a matrix form and a data signal having an amplitude corresponding to a grayscale value from the outside is applied to a switching element to provide a signal to the pixel electrode, including: a first acquisition unit configured to acquire imaging data capturing an image of the display screen when the grayscale value is a predetermined grayscale value and a voltage of the counter electrode is a specific counter voltage; second and third acquisition units configured to acquire imaging data capturing an image of the display screen when a voltage of the counter electrode increases and decreases from the counter voltage by a predetermined voltage, respectively; a detection unit configured to detect a luminance value for each of a plurality of regions of the display screen based on imaging data acquired by the first, second, and third acquisition units, respectively; and a generation unit configured to generate correction data for each of the region, the correction data indicating a correction voltage for correcting a deviation between a voltage of the counter electrode to be set for the signal provided to the pixel electrode and the counter voltage, based on a luminance value detected by the detection unit based on imaging data acquired by the first acquisition unit and a luminance value detected by the detection unit based on imaging data acquired by the second and third acquisition units, respectively.

In this embodiment, the liquid crystal display apparatus to which the generated correction data is applied includes the pixels arranged in a matrix form and defined so as to include the electrode pair of the pixel electrode and the counter electrode facing each other via the liquid crystal layer. By applying the data signal having the amplitude corresponding to the grayscale value from the outside to the switching element dedicated to each pixel, the pixel signal is provided to the pixel electrode, thereby causing the display screen to display an image. In the generation of the correction data indicating the correction voltage, imaging data of the display screen captured when the amplitude of the data signal is the amplitude corresponding to the predetermined grayscale value and the voltage of the counter electrode is the specific counter voltage is acquired by the first acquisition unit and the luminance value for each region is detected. Further, imaging data of the display screen each captured when the voltage of the counter electrode varies from the specific counter voltage by the predetermined voltage in up and down directions, respectively, are acquired by the second and third acquisition unit, and the luminance value for each region is detected. Then, based on the luminance values each detected by acquiring imaging data with the first, second, and third acquisition units, the correction data indicating the correction voltage for correcting the deviation between the voltage of the counter electrode to be originally set and the specific counter voltage being actually set is generated for each region. Accordingly, for a region where there is a deviation between the voltage of the counter electrode to be respectively set for the signal written to the pixel electrode in each region and the specific counter voltage, the correction voltage to be superimposed on the data signal so as to cancel out the deviation can be indicated by the generated correction data.

Details of the Embodiments of the Present Invention

Specific examples of the luminance nonuniformity correction method for a liquid crystal display apparatus and the correction data generation device according to embodiments of the present invention will be described below with reference to attached drawings. However, the present invention is not limited to these examples and is indicated by the claims, and it is intended that all modifications within the meaning and the range equivalent to the claims are included. Further, technical features described in respective embodiments can be combined with each other.

Embodiments

Figure 2:
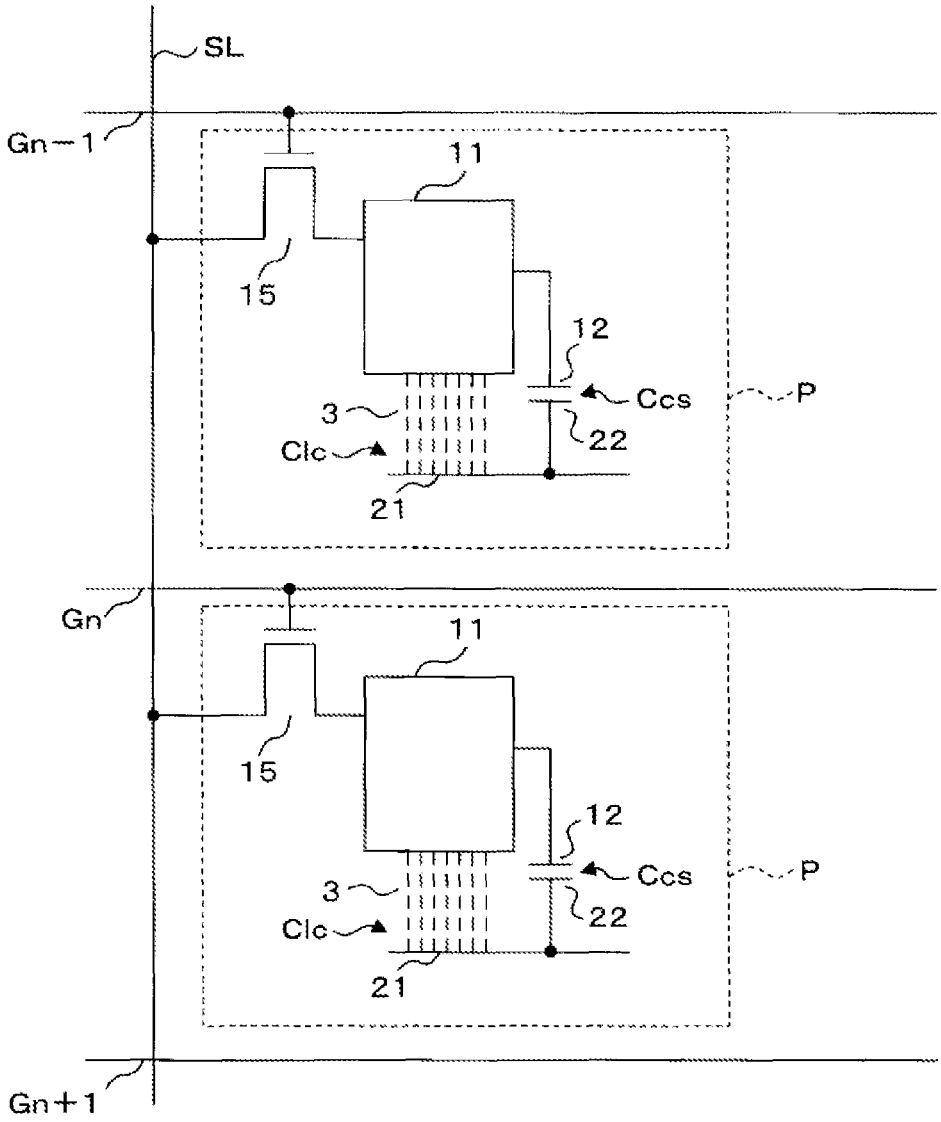
FIG. 2 is an explanatory diagram schematically showing a configuration for defining pixels in the liquid crystal display apparatus according to the embodiment.
Figure 3:
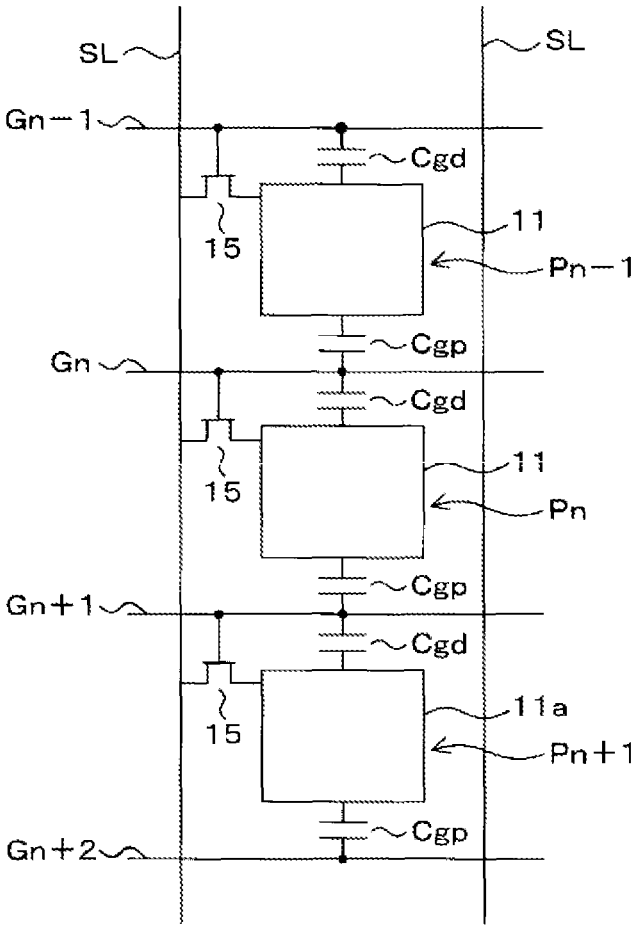
FIG. 3 is an explanatory diagram showing parasitic, capacitance accompanying each pixel in the liquid crystal display apparatus according to the embodiment.

FIG. 1 is a block diagram showing a configuration example of a liquid crystal display apparatus to which a correction data generation device according to an embodiment of the present invention is connected, and FIG. 2 is an explanatory diagram schematically showing a configuration for defining each pixel. P in the liquid crystal display apparatus according to the embodiment. Further, FIG. 3 is an explanatory diagram showing parasitic capacitance accompanying each pixel P in the liquid crystal display apparatus according to the embodiment. In the drawings, 1 is a liquid crystal display apparatus, and 5 is a correction data generation device including, for example, a microcomputer.

The correction data generation device 5 includes a central processing unit (CPU) 51, a storage unit 52 (corresponding to a first storage unit) using a nonvolatile memory such as a flash memory, an erasable programmable read only memory (EPROM) or the like, an input unit 53 to input data, and a communication unit 54 to connect with the liquid crystal display apparatus 1. The CPU 51, the storage unit 52, the input unit 53, and the communication unit 54 are mutually connected in a bus connection. A camera (corresponding to an imaging unit) 6 to capture an image of a display screen of the liquid crystal display apparatus 1 is connected to the input unit 53.

The CPU 51 executes processing according to control programs stored beforehand in the storage unit 52, which includes control of each unit in the bus connection, reading/writing of data from/to the storage unit 52, and various calculations. In particular, the CPU 51 acquires imaging data from the camera 6 using the input unit 53 and transmits correction data generated based on the acquired imaging data and voltage setting data which is described below to the liquid crystal display apparatus 1 using the communication unit 54.

The liquid crystal display apparatus 1 includes a liquid crystal panel 100 in which pixels P each defined so as to include an electrode pair described below are arranged in a matrix form in a vertical direction (hereinafter, referred to as "row direction") and a horizontal direction (hereinafter, referred to as "column direction") of the display screen. In FIG. 1, two pixels P continuing in the row direction on the liquid crystal panel 100 and each signal line relating to these pixels P are representatively illustrated. In the following description, it is assumed that a pair of electrodes facing each other via a liquid crystal layer 3 or an insulating layer (not shown) forms an electrostatic capacitance (capacitor). Further, the rows of the matrix may also be referred to as lines.

In FIG. 2, the pixel P is defined to include an electrode pair of a pixel electrode 11 and a counter electrode 21 facing each other via the liquid crystal layer 3 and an electrode pair of an auxiliary capacitance electrode 12 and an auxiliary capacitance counter electrode 22. A drain electrode of a TFT (corresponding to a switching element) 15 is connected to the pixel electrode 11. The pixel electrode 11 and the auxiliary capacitance electrode 12 are electrically connected. The auxiliary capacitance counter electrode 22 is connected to the potential of the counter electrode 21. The auxiliary capacitance counter electrode 22 may be connected to a predetermined potential different from the potential of the counter electrode 21. The pixel electrode 11 and the counter electrode 21 form a liquid crystal capacitance Clc. The auxiliary capacitance electrode 12 and the auxiliary capacitance counter electrode 22 form an auxiliary capacitance Ccs.

A source signal line SU for applying a source signal (corresponding to a data signal) to a source electrode of the TFT 15 is linearly arranged in the vertical direction on one side of the pixel. P in the horizontal direction. A gate electrode of the TFT 15 of an n-th line is connected to a scanning signal line Gn linearly arranged in such a way as to horizontally cross between the pixel P in the n-th line and the pixel P in an (n−1)-th line. Scanning signal lines Gn−1, Gn, Gn+1, - - - are juxtaposed row by row in the row direction of the matrix.

Referring back to FIG. 1, the liquid crystal display apparatus 1 according to the present embodiment includes gate drivers GD and GD to apply the scanning signal to the scanning signal lines Gn−1, Gn, Gn+1, - - - , a source driver SD to apply the source signal to source signal lines SL, SL, - - - , and a display control circuit 4 to control display of the liquid crystal panel 100 (hereinafter, simply referred to as "panel") by using the gate drivers GD and GD and the source driver SD.

The display control circuit 4 includes a signal input circuit 40 to which an image signal including image data representing an image and a signal (or data such as correction data) from the correction data generation device 5 are input, a scanning signal control circuit 42 and a source signal control circuit 41 to control the gate drivers GD and GD and the source driver SD respectively based on a clock signal and a sync signal separated from the image signal by the signal input circuit 40, and a counter voltage application circuit 43 to apply a voltage to the counter electrode 21.

In addition to the function of separating image data and various signals from the image signal, the signal input circuit 40 includes a storage unit (corresponding to a second storage unit) 401 configured to store the correction data received from the correction data generation device 5 via the communication unit 54, in association with the region on the display screen. The signal input circuit 40 corrects a grayscale value included in digital image data based on the correction data read out from the storage unit 401.

The scanning signal control circuit 42 and the source signal control circuit 41 respectively generate control signals, for example, a start signal required for periodic operations of the gate drivers GD and GD and the source driver SD, the clock signal, and an enable signal. Further, the source signal control circuit 41 sends a grayscale correction value, which has been obtained by performing gamma correction for the grayscale value corrected by the signal input circuit 40, to the source driver SD for each horizontal scanning period. The gamma correction may be performed by the signal input circuit 40.

The counter voltage application circuit 43 is configured to set a voltage to be applied to the counter electrode 21 based on voltage setting data transmitted from the correction data generation device 5. The counter voltage application circuit 43 is not limited to this example and may be configured to set the voltage to be applied to the counter electrode 21, for example, according to a setting value received by a reception unit (not shown) in the display control circuit 4.

The gate drivers GD and GD sequentially apply the scanning signal to the scanning signal lines Gn−1, Gn, Gn+1, - - - , for each horizontal scanning period, within one frame period of the image data. The scanning signal applied to one of the scanning signal lines Gn−1, Gn, Gn+1, - - - is applied to the gate electrode of the TFT 15 included in each of the pixels P, P, - - - of one line arranged in the column direction.

The source driver SD performs D/A conversion on the grayscale correction value from the source signal control circuit 41 to generate an analog source signal (parallel signal) representing an image corresponding to one line, and parallelly applies the generated source signal to the source signal lines SL, SL, - - - for every column. The source signal in this stage is a signal in which a correction voltage corresponding to the correction data is superimposed on a signal having an amplitude corresponding to the grayscale value of each pixel P included in the image data.

In the case of applying the source signal on which the correction voltage is superimposed to the source signal lines SL, SL, - - - , in one horizontal scanning period during which the scanning signal is applied to one scanning signal line Gn, the pixel signal is provided to the pixel electrode 11 via the TFT 15 having the gate electrode connected to this scanning signal line Gn, and the pixel signal is also provided to the auxiliary capacitance electrode 12. That is, the pixel signal is written in the liquid crystal capacitance Clc and the auxiliary capacitance Ccs each formed in the pixel P. In this manner, in one horizontal scanning period, the pixel signals corresponding to one line are simultaneously written into the pixel P, P, - - - of one line. The pixel signal written in each pixel P is held during one frame period. Hereinafter, providing or writing the pixel signal to the pixel P and providing or writing the pixel signal to the pixel electrode 11 are used for equivalent meaning.

Referring to FIG. 3, in the following description, the pixel P on the n-th line (n is an integer equal to or greater than 0, the same applies hereinafter) is denoted by Pn, for the sake of convenience. Since the parasitic capacitance accompanies any of the pixels Pn−1, Pn, and Pn+1 similarly, the pixel Pn is mainly described hereinafter. In the TFT 15 having the drain electrode connected to the pixel electrode 11 of the pixel Pn, the parasitic capacitance exists between the gate and drain. Further, a stray capacitance exists between the scanning signal line Gn connected to the gate electrode of the TFT 15 and the pixel electrode 11 of the pixel Pn. Since the parasitic capacitance and the stray capacitance between the gate and drain act as parallel capacitances, these capacitances are collectively referred to as a parasitic capacitance Cgd. On the other hand, a stray capacitance exists between the pixel electrode 11 of the pixel Pn and the scanning signal line Gn+1. This is referred to as a parasitic capacitance Cgp.

In the above-mentioned configuration, it is known that a feedthrough voltage (so-called pull-in voltage) occurs due to the influence of the parasitic capacitance Cgd in the TFT 15 at the falling time of the drive voltage on the gate and the voltage of the pixel signal provided to the pixel electrode 11 (hereinafter, simply referred to as "voltage of the pixel electrode 11") becomes lower than the voltage of the source signal applied to the TFT 15. For example, when the capacitance of the pixel Pn is assumed to be Cpx (the capacitance corresponds to a sum of the liquid crystal capacitance Clc, auxiliary capacitance Css parallelly connected to the liquid crystal capacitance Clc, and the parasitic capacitances Cgd and Cgp), the above-mentioned pull-in voltage ΔVd can be expressed by the following formula (1).

$$\Delta Vd=(Cgd/Cpx)\times(VgH-VgL) \quad (1)$$

VgH: voltage when the scanning signal is HI level

VgL: voltage when the scanning signal is LOW level

Since the actual scanning signal line Gn can be regarded as a distributed constant line having a reactance component and a resistance component, the scanning signal has a waveform deforming with distance from a drive end. Therefore, the magnitude of the pull-in voltage expressed by the formula (1) varies depending on the position on the panel in the direction along the scanning signal line Gn. Further, even when the separation distance from the drive end is the same, as understood from the formula (1), if the magnitude of Cgd and/or the magnitude of Cpx are different, the magnitude of the pull-in voltage varies for each pixel P.

Figure 4:
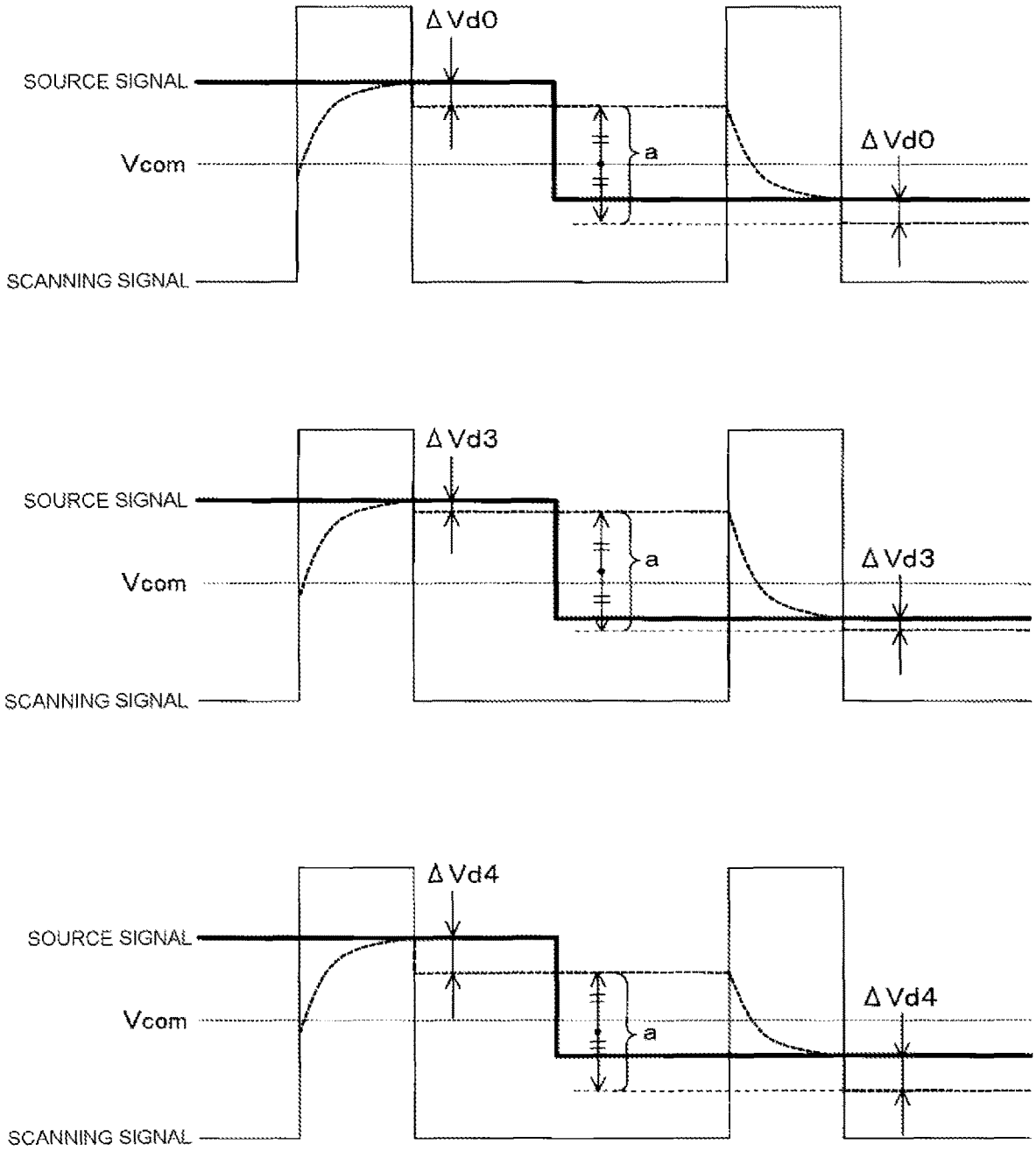
FIG. 4 is an explanatory diagram for explaining relationships between a pull-in voltage and an optimum counter voltage.
Figure 5:
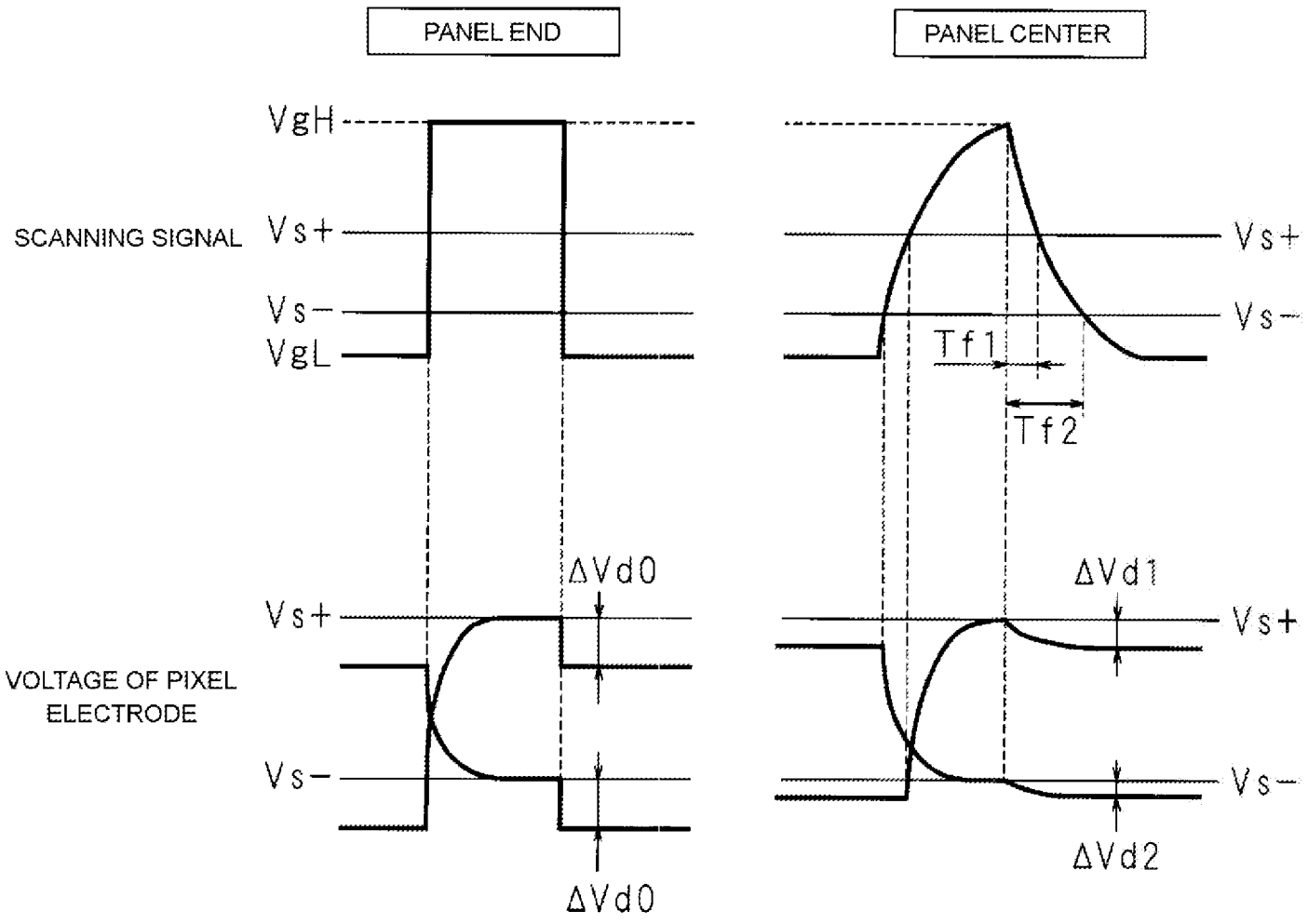
FIG. 5 is a timing diagram showing temporal changes of a scanning signal applied to a scanning signal line and voltage of a pixel electrode.
Figure 6:
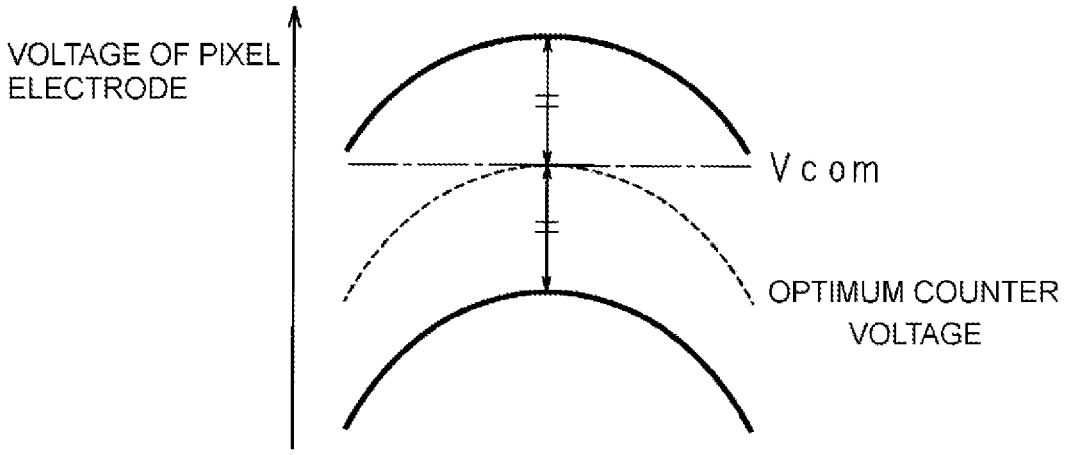
FIG. 6 is an explanatory diagram for explaining a distribution of the optimum counter voltage of pixels on the same line and luminance nonuniformity.
Figure 6:
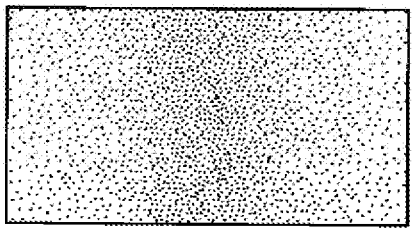

Next, influences due to differences in the magnitude of the pull-in voltage will be described with reference to the drawings. FIG. 4 is an explanatory diagram for explaining relationships between the pull-in voltage and the optimum counter voltage, and FIG. 5 is a timing diagram showing temporal changes of the scanning signal applied to the scanning signal line Gn and the voltage of the pixel electrode 11. Further, FIG. 6 is an explanatory diagram for explaining a distribution of optimum counter voltages of the pixels P, P, - - - on the same line and the luminance nonuniformity.

In FIG. 4, the waveform of the voltage of the pixel electrode 11 influenced by the pull-in voltage is indicated in each of upper, middle, and lower parts by a bold dotted line. In the drawing, the horizontal axis represents time. A bold solid line in the drawing represents the waveform of the source signal applied to the TFT 15, and a thin solid line represents the waveform of the scanning signal. Vcom is the voltage of the counter electrode 21. The source signal is, for example, a signal whose polarity is inverted at every frame period, and the scanning signal is a positive pulse applied to the scanning signal line Gn at every frame period. The amplitude of the source signal normally varies for each pixel P and for each frame. However, in the following description, it is assumed that the amplitude of the source signal is constant.

In each of the upper; middle, and lower parts of FIG. 4, magnitudes of pull-in voltages ΔVd0, ΔVd3 and, ΔVd4 which occur in the voltage of the pixel electrode 11 are in a magnitude relationship expressed by the following formula (2).

$$\Delta Vd3<\Delta Vd0<\Delta Vd4 \quad (2)$$

Further, it is assumed that the magnitude of the pull-in voltage when a positive pixel signal is written to the pixel electrode 11 is equal to the magnitude of the pull-in voltage when a negative pixel signal is written after one frame period. A root-mean-square (RMS) calculated for a difference between the voltage actually written to the pixel electrode 11 by subtracting the magnitude of the pull-in voltage and the voltage of the counter electrode 21 is an effective voltage applied to the liquid crystal layer 3 by the pixel P.

It is preferable that the voltage of the counter electrode 21 is set to an intermediate voltage between the positive and negative pixel signals written to the pixel electrode 11. Such an intermediate voltage is referred to as the optimum counter voltage. The voltage corresponding to the midpoint of a line segment having a length "a" shown in FIG. 4 is to be the optimum counter voltage. Vcom shown in the upper part of FIG. 4 coincides with the optimum counter voltage. On the other hand, Vcom shown in the middle part of FIG. 4 is deviated to the minus side from the optimum counter voltage. To the contrary, Vcom shown in the lower part of FIG. 4 is deviated to the plus side from the optimum counter voltage. Although the amplitude of the voltage of the pixel electrode 11 is the same in any case, the effective voltage applied to the liquid crystal layer 3 is smallest in the case illustrated in the upper part of FIG. 4 and becomes greater in the cases illustrated in the middle and lower parts of FIG. 4.

Referring to FIG. 5, waveforms of the scanning signal and waveforms of the voltage of the pixel electrode 11 at a panel end and a panel center in the direction along the scanning signal line Gn are illustrated in each of upper and lower parts of the drawing. In the drawing, the horizontal axis represents time. The scanning signal is driven, for example, from the right and left ends of the panel. In the drawing, Vs+ and Vs− represent signal levels of positive and negative source signals, respectively. The positive/negative represents a high/low relationship of voltages. That is, the source signal applied to the TFT 15 has an amplitude of "(Vs+)−(Vs−)".

At the end of the liquid crystal panel 100, namely at the drive end of the scanning signal, the scanning signal steeply falls and the voltage of the pixel electrode 11 decreases by ΔVd0 from the voltage Vs+(or Vs−) of the source signal due to a pull-in voltage according to the amplitude of this falling. ΔVd0 corresponds to the value expressed by the formula (1). In FIG. 5, the case of applying a positive source signal to the TFT 15 and the case of applying a negative source signal to the TFT 15 are superposed with each other.

On the other hand, at the center of the panel, deformation in rise and fail of the scanning signal occur. Therefore, when the voltage of the scanning signal exceeds a voltage higher than the voltage Vs+ (or Vs−) of the source signal by a threshold level of the TFT 15, the TFT 15 is turned on and the pixel signal is written to the pixel electrode 11. Subsequently, when the voltage of the scanning signal falls below a voltage higher than the voltage of the source signal by the threshold level of the TFT 15, the TFT 15 is turned off. In FIG. 5, the threshold level of the TFT 15 is assumed to be 0 V for simplicity. As shown in the drawings, at the center of the panel, when a positive (or negative) pixel signal is written to the pixel electrode 11, time Tf1 (or Tf2) is required after the scanning signal starts falling until the TFT 15 turns off.

Since the TFT 15 slowly turns from ON to OFF during this time Tf1 (or Tf2), charge transfer (so-called recharging) occurs between the source signal line SL and the pixel electrode 11 and a pull-in voltage ΔVd1 (or ΔVd2) smaller than ΔVd0 is generated. The magnitude of ΔVd1 (or ΔVd2) decreases with increase in the time Tf1 (or Tf2) during which the recharging occurs. That is, as approaching the center from the end of the panel, the magnitude of the pull-in voltage considering the recharging becomes smaller and the reduction amount of the voltage of the pixel electrode 11 becomes smaller. Further, since the pull-in voltage considering the recharging is smaller when the negative pixel signal is written than when the positive pixel signal is written, the amplitude of the voltage of the pixel electrode 11 becomes smaller as approaching the center from the end of the panel. In this case, when the voltage of the counter electrode 21 is set to the optimum counter voltage, the effective voltage applied to the liquid crystal layer 3 decreases.

Referring to FIG. 6, distributions of the voltage of the pixel electrode 11 in the case of applying the source signals having a uniform amplitude to each TFT 15 corresponding to one line and the luminance nonuniformity on the display screen of the liquid crystal panel 100 are shown in the upper part and lower part, respectively. In the upper part of the drawing, the case of writing a positive pixel signal to the pixel electrode 11 and the case of writing a negative pixel signal to the pixel electrode 11 are indicated by solid lines vertically positioned. In the drawing, the horizontal axis represents the distance from a left end of the panel. Vcom indicated by an alternate long and short dash line in the drawing is the voltage of the counter electrode 21. The scanning signals are driven by the gate drivers GD and GD on the right and left ends of the panel.

Due to characteristics of the above-mentioned pull-in voltage considering the recharging, the distribution of the voltage of the pixel electrode 11 draws an upward convex curve becoming minimum at both ends of the panel and becoming maximum at the center of the panel. When the voltage of the pixel electrode 11 has the distribution characteristics shown in the upper part of FIG. 6, the optimum counter voltage varies in such a way as to draw an upward convex curve shown by a dotted line.

Normally, the voltage of the counter electrode 21 is set to a uniform counter voltage across the entire of the liquid crystal panel 100. Therefore, in a case where the counter voltage coincides with the optimum counter voltage at the center of the panel, the counter voltage applied to the counter electrode 21 is deviated to the plus side from the optimum counter voltage at the end of the panel as shown in the upper part of FIG. 6. In addition to this, as mentioned above, the amplitude of the voltage of the pixel electrode 11 becomes smaller as approaching from the end to the center of the panel. Therefore, the effective voltage applied to the liquid crystal layer 3 at the end of the panel becomes relatively large and the luminance increases. As a result, as shown in the lower part of FIG. 6, the luminance nonuniformity occurs in such a manner that an image is displayed on the screen relatively brightly at the end of the panel.

Figure 7:
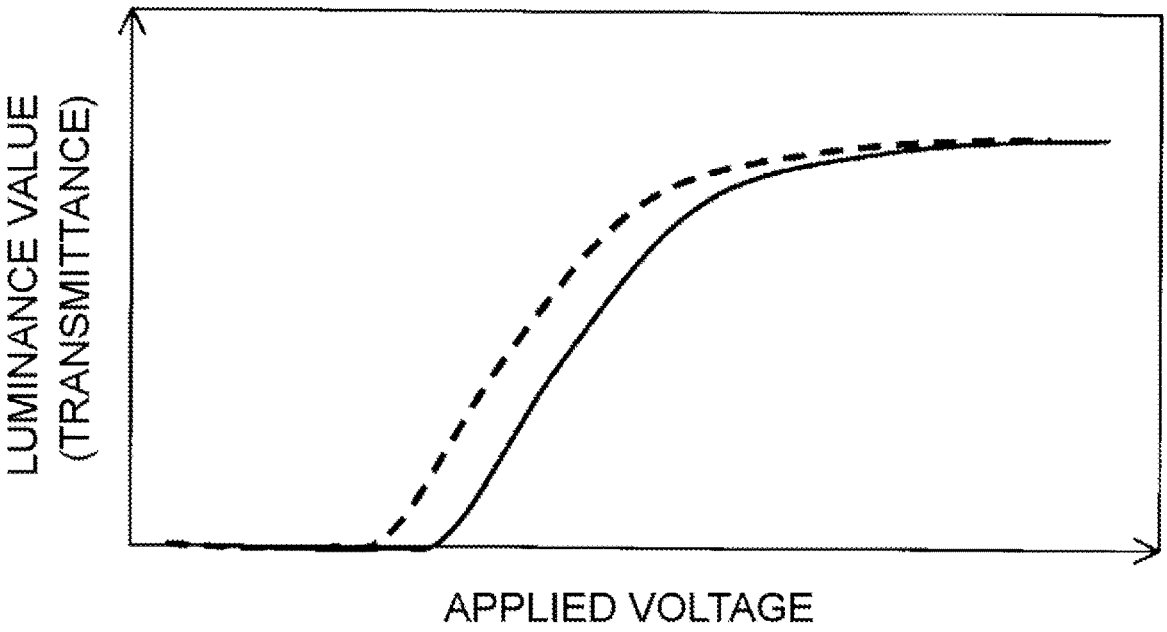
FIG. 7 is a graph showing relationships between the voltage applied to a liquid crystal layer and the luminance value of the pixel.
Figure 8:
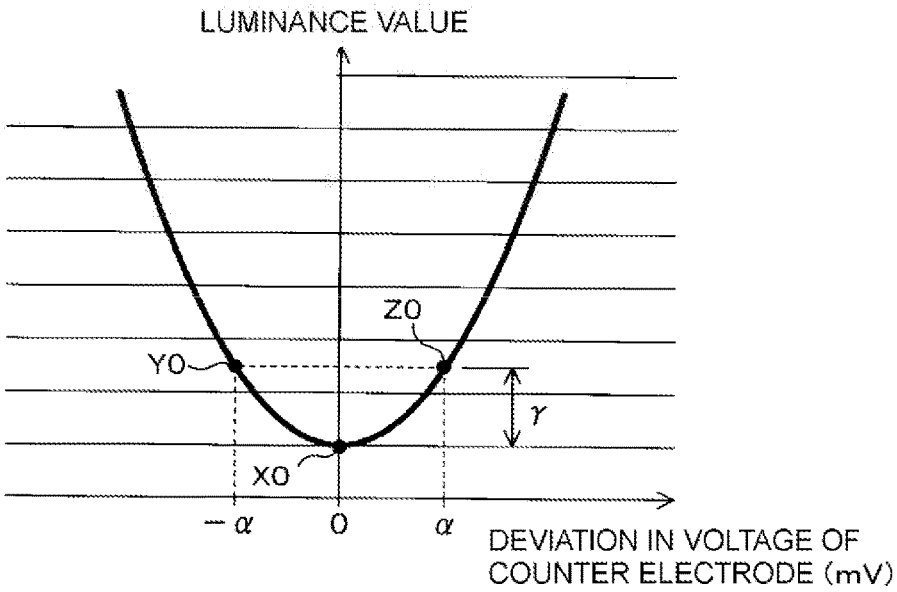
FIG. 8 is a graph showing a relationship between a deviation of the voltage of a counter electrode with respect to the optimum counter voltage and the luminance value of the pixel.

Next, the influence due to the deviation between the counter voltage set for the counter electrode 21 and the optimum counter voltage will be described with reference to the drawings. FIG. 7 is a graph showing relationships between the voltage applied to the liquid crystal layer 3 and the luminance value of the pixel P, and FIG. 8 is a graph showing a relationship between the deviation in the voltage of the counter electrode 21 with respect to the optimum counter voltage and the luminance value of the pixel P.

First, in FIG. 7, the horizontal axis represents the voltage applied to the pixel electrode 11 by providing the pixel signal to the pixel electrode 11, and the vertical axis represents the luminance value (i.e., light transmittance of the pixel P). The solid line indicates so-called V-T characteristics when the voltage of the counter electrode 21 is set to the optimum counter voltage in a normally black type liquid crystal panel 100, and the dotted line indicates V-T characteristics when the voltage of the counter electrode 21 is set to deviate from the optimum counter voltage in either up or down direction.

In the case of applying a voltage having an amplitude larger than a certain amplitude to the pixel electrode 11 in the normally black type liquid crystal panel 100, the array direction of liquid crystal molecules changes according to the increase of the effective value of the applied voltage, and the light transmittance increases correspondingly. Therefore, an increase in the luminance of the pixel P can be observed. As described with reference to FIG. 4, even when a voltage having the same amplitude is applied to the pixel electrode 11, if the voltage of the counter electrode 21 is set to deviate from the optimum counter voltage in either up or down direction, the effective voltage becomes greater and the luminance value of the pixel P becomes larger, compared to the case where the voltage of the counter electrode 21 is set to the optimum counter voltage.

In other words, in a case where the voltage of the counter electrode 21 is set to deviate from the optimum counter voltage in either up or down direction, a comparable luminance can be obtained with a smaller applied voltage, compared to the case where the voltage of the counter electrode 21 is set to the optic counter voltage. Therefore, the graph of V-T characteristics indicated by the dotted line is drawn closely to the origin than the graph of V-T characteristics indicated by the solid line.

Referring to FIG. 8, the horizontal axis represents the deviation in the voltage of the counter electrode 21 (mV) with respect to the optimum counter voltage, and the vertical axis represents the luminance value of the pixel P. Even when the voltage of the counter electrode 21 is deviated in either up or down direction (i.e., the plus side or the minus side) from the optimum counter voltage, if an amount of the deviation is the same, the effective voltage increases by the same amount and the luminance value of the pixel P increases by the same amount. Accordingly, characteristics of the luminance of the pixel P (hereinafter, the luminance of the pixel P is simply referred to as "luminance") with respect to the deviation of the counter electrode 21 can be expressed by a downward convex even function taking a minimal value when the deviation in the voltage of the counter electrode 21 is 0 mV. The luminance value when the voltage of the counter electrode 21 is set to the optimum counter voltage corresponds to the luminance value at point X0 that is a minimal point of the graph illustrated in FIG. 8.

The deviation of the counter electrode 21 is the deviation relative to the optimum counter voltage. Since the optimum counter voltage is an intermediate voltage between the positive and negative pixel signals written to the pixel electrode 11, the luminance values when positive and negative voltages are respectively superimposed on the pixel signal become equivalent to the luminance values when the voltage of the counter electrode 21 deviates by the same voltage to the plus and minus sides. Therefore, for example, the luminance value when a voltage of $-\alpha$ mV ($\alpha$ is a positive real number) is superimposed on the pixel signal becomes equivalent to the luminance value at point Y0 where the voltage of the counter electrode 21 deviates by $-\alpha$ mV. Similarly, the luminance value when a voltage of $+\alpha$ mV (corresponding to the predetermined voltage) is superimposed on the pixel signal becomes equivalent to the luminance value at point Z0 where the voltage of the counter electrode 21 deviate by $+\alpha$ mV. The value indicated by $\gamma$ in the drawing is the change amount of the luminance value when varying the voltage of the counter electrode 21 by $-\alpha$ mV or +α mV with respect to the luminance value when the voltage of the counter electrode 21 is set to the optimum counter voltage.

From the above, when the deviation direction (i.e., the polarity of the deviation) and the magnitude of the voltage of the counter electrode 21 are detected, by superimposing a correction voltage having the same polarity and the same magnitude on the source signal, a correction voltage having the same magnitude is superimposed on the pixel signal to be written in the pixel electrode 11. Therefore, it is possible to equalize the voltage of the counter electrode 21 to the optimum counter voltage equivalently. Hereinafter, a method for determining the polarity and the magnitude of the correction voltage to be superimposed on the source signal for correcting the deviation in the voltage of the counter electrode 21, in the case where the voltage of the counter electrode 21 is set to deviate from the optimum counter voltage in either up or down direction, will be described.

Figure 9A:
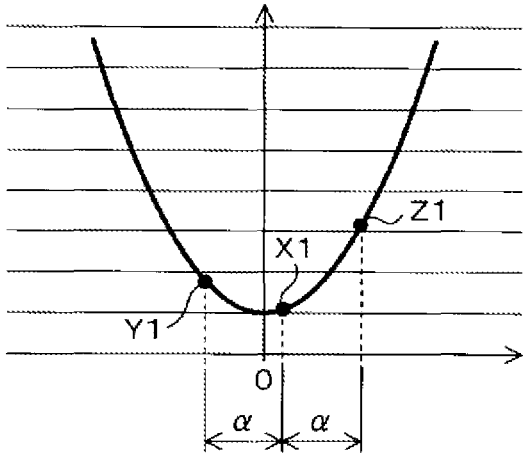
FIG. 9A is an explanatory diagram for explaining the luminance when further varying the voltage of the counter electrode by a certain value in a state where the voltage of the counter electrode deviates to the plus side.
Figure 9B:
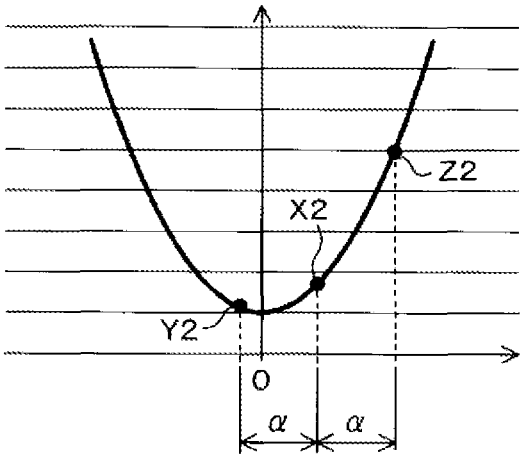
FIG. 9B is an explanatory diagram for explaining the luminance when further varying the voltage of the counter electrode by a certain value in the state where the voltage of the counter electrode deviates to the plus side.
Figure 9C:
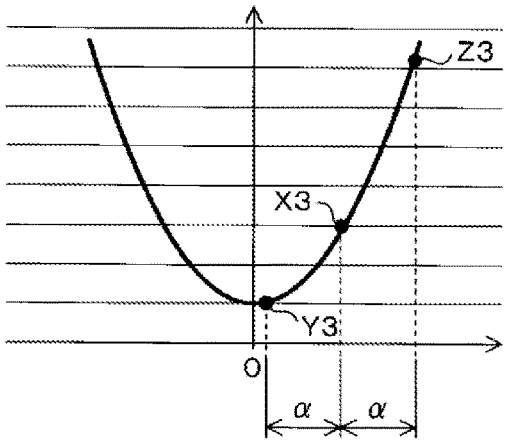
FIG. 9C is an explanatory diagram for explaining the luminance when further varying the voltage of the counter electrode by a certain value in the state where the voltage of the counter electrode deviates to the plus side.
Figure 10A:
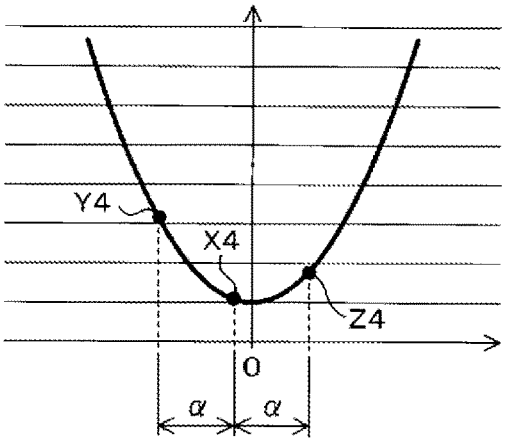
FIG. 10A is an explanatory diagram for explaining the luminance when further varying the voltage of the counter electrode by a certain value in a state where the voltage of the counter electrode deviates to the minus side.

FIGS. 9A, 9B, and 9C are explanatory diagrams for explaining the luminance when further varying the voltage of the counter electrode 21 by a certain value in the case where the voltage of the counter electrode 21 deviates to the plus side. FIGS. 10A, 103, and 10C are explanatory diagrams for explaining the luminance when varying the voltage of the counter electrode 21 by a certain value, in the case where the voltage of the counter electrode 21 deviates to the minus side. In each of the six drawings from FIGS. 9A to 10C, the horizontal axis represents the deviation (mV) of the voltage of the counter electrode 21 and the vertical axis represents the luminance value. In each drawing, expressions of the horizontal and vertical axes are omitted.

First, in the case of FIG. 9A, a state where the voltage of the counter electrode 21 deviates to the plus side by a value less than α/2 is taken as a reference state. The luminance value in this reference state corresponds to the luminance value at point X1 on the graph, and the luminance values when varying the voltage of the counter electrode 21 from this state by −α mV and +α mV, respectively, correspond to the luminance values at points Y1 and Z1 on the graph. Coordinate values of the points X1, Y1, and Z1 on the horizontal axis are larger by a value less than α/2 compared to coordinate values of the points X0, Y0, and Z0 on the horizontal axis of the graph shown in FIG. 8. The luminance value at the point Y1 is larger than the luminance value at the point X1.

On the other hand, in the case of FIG. 9B, a state where the voltage of the counter electrode 21 deviates to the plus side by a value equal to or greater than α/2 and less than α is taken as a reference state. The luminance value in this reference state corresponds to the luminance value at point X2 on the graph, and the luminance values when varying the voltage of the counter electrode 21 from this state by −α mV and +α my, respectively correspond to the luminance values at points Y2 and Z2 on the graph. Coordinate values of the points X2, Y2 and Z2 on the horizontal axis are larger by a value equal to or greater than α/2 and less than α compared to coordinate values of the points X0, Y0 and Z0 on the horizontal axis of the graph shown in FIG. 8. The luminance value at the point Y2 is smaller than the luminance value at the point X2.

In the case of FIG. 9C, a state where the voltage of the counter electrode 21 deviates to the plus side by a value equal to or greater than α is taken as a reference state. The luminance value in this reference state corresponds to the luminance value at point X3 on the graph, and the luminance values when varying the voltage of the counter electrode 21 from this state by −α mV and +α mV, respectively, correspond to the luminance values at points Y3 and Z3 on the graph. Coordinate values of the points X3, Y3, and Z3 on the horizontal axis are larger by a value equal to or greater than α compared to coordinate values of the points X0, Y0 and Z0 on the horizontal axis of the graph shown in FIG. 8.

Next, in the case of FIG. 10A, a state where the voltage of the counter electrode 21 deviates to the minus side by a value less than α/2 is taken as a reference state. The luminance value in this reference state corresponds to the luminance value at point X4 on the graph, and the luminance values when varying the voltage of the counter electrode 21 from this state by −α mV and +α mV, respectively, correspond to the luminance values at points Y4 and Z4 on the graph. Coordinate values of the points X4, Y4 and Z4 on the horizontal axis are smaller by a value less than α/2 compared to coordinate values of the points X0, Y0 and Z0 on the horizontal axis of the graph shown in FIG. 8. The luminance value at the point Z4 is larger than the luminance value at the point X4.

Figure 10B:
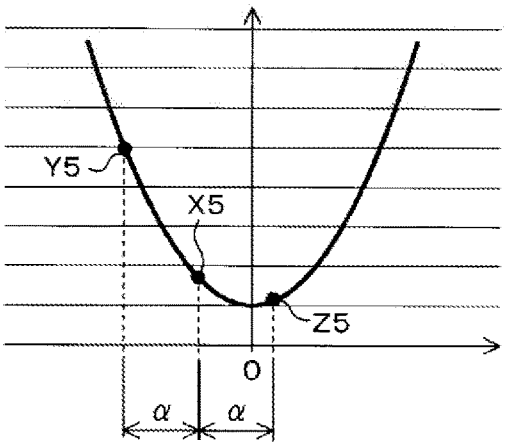
FIG. 10B is an explanatory diagram for explaining the luminance when further varying the voltage of the counter electrode by a certain value in the state where the voltage of the counter electrode deviates to the minus side.
Figure 10C:
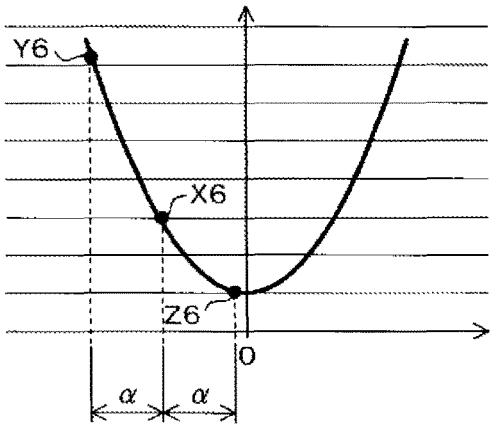

On the other hand, in the case of FIG. 10B, a state where the voltage of the counter electrode 21 deviates to the minus side by a value equal to or greater than α/2 and less than α is taken as a reference state. The luminance value in this reference state corresponds to the luminance value at point X5 on the graph, and the luminance values when varying the voltage of the counter electrode 21 from this state by −α mV and +α mV, respectively, correspond to the luminance values at points Y5 and Z5 on the graph. Coordinate values of the points X5, Y5 and Z5 on the horizontal axis are smaller by a value equal to or greater than α/2 and less than α compared to coordinate values of the points X0, Y0 and Z0 on the horizontal axis of the graph shown in FIG. 8. The luminance value at the point Z5 is smaller than the luminance value at the point X5.

In the case of FIG. 10C, a state where the voltage of the counter electrode 21 deviates to the minus side by a value equal to or greater than α is taken as a reference state. The luminance value in this reference state corresponds to the luminance value at point X6 on the graph, and the luminance values when varying the voltage of the counter electrode 21 from this state by −α mV and +α mV, respectively, correspond to the luminance values at points Y6 and Z6 on the graph. Coordinate values of the points X6, Y6 and Z6 on the horizontal axis are smaller by a value equal to or greater than α compared to coordinate values of the points X0, Y0 and Z0 on the horizontal axis of the graph shown in FIG. 8.

Here, a method for detecting the deviation direction of the voltage of the counter electrode 21 will be described with reference to the six drawings of FIGS. 9A to 10C. When the luminance values at points Yn and Zn (n is an integer from 1 to 6), namely coordinate values of the points Yn and Zn on the vertical axis, are compared, a relationship indicated by the following formula (3) constantly holds in the cases of FIGS. 9A, 9B, and 9C, and a relationship indicated by the following formula (4) constantly holds in the cases of FIGS. 10A, 10B, and 10C. For the sake of convenience, the case where there is no deviation in the voltage of the counter electrode 21 has been included in the formula. (3).

$$(\text{Luminance value at point } Yn) \leq (\text{Luminance value at point } Zn) \quad (3)$$

$$(\text{Luminance value at point } Yn) > (\text{Luminance value at point } Zn) \quad (4)$$

Since the every case regarding the magnitude relationship between the luminance values at points Xn, Yn, and Zn (n is an integer from 1 to 6) is represented in either one of the six drawings of FIGS. 9A to 10C, it is possible to detect the deviation direction of the voltage of the counter electrode 21 by determining which holds between the formulae (3) and (4). More specifically, the luminance values at point Yn and point Zn are replaced with the luminance values then varying the voltage of the counter electrode 21 by −α mV and +α mV, respectively, and it is determined whether the following formulae (5) and (6) hold or not, respectively. When the formula (5) holds, the voltage of the counter electrode 21 does not deviate or deviates to the plus side. When the formula (6) holds, it is detected that the voltage of the counter electrode 21 deviates to the minus side.

(Luminance value when varying the voltage of the counter electrode 21 by −α mV)≤(Luminance value when varying the voltage of the counter electrode 21 by +α mV) (5)

(Luminance value when varying the voltage of the counter electrode 21 by −α mV)>(Luminance value when varying the voltage of the counter electrode 21 by +α mV) (6)

Once the deviation direction of the voltage of the counter electrode 21 is detected, the polarity of a correction voltage to be superimposed on the pixel signal for cancelling out the deviation is determined. For example, when the deviation in the voltage of the counter electrode 21 to the plus side (or the minus side) with respect to the optimum counter voltage is detected, the luminance of the pixel P can be suppressed from varying by superimposing a positive (or negative) correction voltage on the pixel signal. Therefore, the luminance nonuniformity is reduced.

Next, a method for determining the magnitude of the correction voltage will be described with reference to the six drawings of FIGS. 9A to 10C. It is understood that there is a one-to-one relationship between the change amount of the luminance value at point Yn or point Zn with respect to the luminance value at point Xn shown in these drawings and the coordinate values of point Xn on the horizontal axis (i.e., the deviation of the voltage of the counter electrode 21.

Specifically, in FIGS. 9A, 9B, and 9C, it can be said that the change amount of the luminance value at point Zn with respect to the luminance value at point Xn becomes larger as the deviation to the plus side in the voltage of the counter electrode 21 becomes larger. Further, it can be said that the change amount of the luminance value at point Yn with respect to the luminance value at point Xn becomes smaller continuously from positive values to negative values as the deviation to the plus side in the voltage of the counter electrode 21 becomes larger. Similarly, in FIGS. 10A, 10B, and 10C, it can be said that the change amount of the luminance value at point Xn with respect to the luminance value at point Xn becomes larger as the deviation to the minus side in the voltage of the counter electrode 21 becomes larger. Further, it can be said that the change amount of the luminance value at point Zn with respect to the luminance value at point Xn becomes smaller continuously from positive values to negative values as the deviation to the minus side in the voltage of the counter electrode 21 becomes larger.

From the above, by calculating the change amount of the luminance value when varying the voltage of the counter electrode 21 by −α mV or +α mV (corresponding to the luminance value at point Yn or point Zn) with respect to the luminance value detected before varying the voltage of the counter electrode 21 (corresponding to the luminance value at point Xn), it is possible to detect the magnitude of the deviation in the voltage of the counter electrode 21 based on the calculated change amount. More specifically, when the previously detected deviation direction of the voltage of the counter electrode 21 is the plus side, the above-mentioned change amount can be calculated based on the matters grasped from FIGS. 9A, 9B, and 9C. When the deviation direction is the minus side, the above-mentioned change amount can be calculated based on the matters grasped from FIGS. 10A, 10B, and 10C.

For example, when the deviation direction of the voltage of the counter electrode 21 is detected as the plus side, according to the matters grasped from FIGS. 9A, 9B, and 9C, the change amount of the luminance value when varying the voltage of the counter electrode 21 by −α mV or +α mV with respect to the luminance value detected before varying the voltage of the counter electrode 21 is to be calculated. In this case, the change amount can be uniquely calculated even when varying the voltage of the counter electrode 21 by either −α mV or +α mV. However, by calculating the change amount when varying the voltage by −α mV, the amount of the deviation of the voltage of the counter electrode 21 can be detected more accurately because the possibility that change amount to be calculated is dispersed from positive values to negative values becomes higher. On the other hand, when the deviation direction of the voltage of the counter electrode 21 is detected as the minus side, by calculating the change amount when varying the voltage of the counter electrode 21 by +α my, the amount of the deviation of the voltage of the counter electrode 21 can be detected more accurately.

In this case, for all regions of the display screen, it is preferable to preliminarily set the voltage of the counter electrode 21 to be an intermediate voltage among the optimum counter voltages of all regions, so that the deviation direction of the voltage of the counter electrode 21 is appropriately dispersed on the plus and minus sides. Further, it is preferable to set the magnitude of α to be sufficiently large so that the change in the luminance value when varying the voltage of the counter electrode 21 by −α mV and +α mV approximately results in the cases of FIGS. 9A and 9B and FIGS. 1.0A and 10B (namely, so that the curve extending from point Yn to point Zn passes through the minimal point).

In order to detect the amount of the deviation of the voltage of the counter electrode 21 based on the calculated change amount, it is possible to use a calculation formula based on the even function indicated by the graph of FIG. 8. Information that associates the above-mentioned change amount with the amount of the deviation of the voltage of the counter electrode 21 can be acquired or calculated and stored beforehand in the storage unit 52. The magnitude of the deviation in the voltage of the counter electrode 21 can be detected based on the calculated change amount and the information stored in the storage unit 52, and it is possible to determine the detected magnitude as the magnitude of the correction voltage.

The change amount relating to the information to be stored in the storage unit 52 may be the change amount of the luminance value when varying the voltage of the counter electrode 21 by −α mV or +α mV with respect to the luminance value detected before varying the voltage of the counter electrode 21, or may be the luminance difference between the luminance value when varying the voltage of the counter electrode 21 by −α mV or +α mV and the luminance value detected before varying the voltage of the counter electrode 21. Further, the information to be stored in the storage unit 52 may be information that associates the above-mentioned change amount with the magnitude of the correction voltage. In the present embodiment, when the above-mentioned formula (5) holds, the luminance difference is detected by the following formula (7). When the above-mentioned formula. (6) holds, the luminance difference is detected by the following formula (8). When the equality in the formula (5) holds, the luminance difference is detected as zero according to the formula (7).

Luminance difference=(Luminance value before varying the voltage of the counter electrode 21)−(Luminance value when varying the voltage of the counter electrode 21 by −α mV) (7)

Luminance difference=(Luminance value before varying the voltage of the counter electrode 21)−(Luminance value when varying the voltage of the counter electrode 21 by +α mV) (8)

Figure 11:
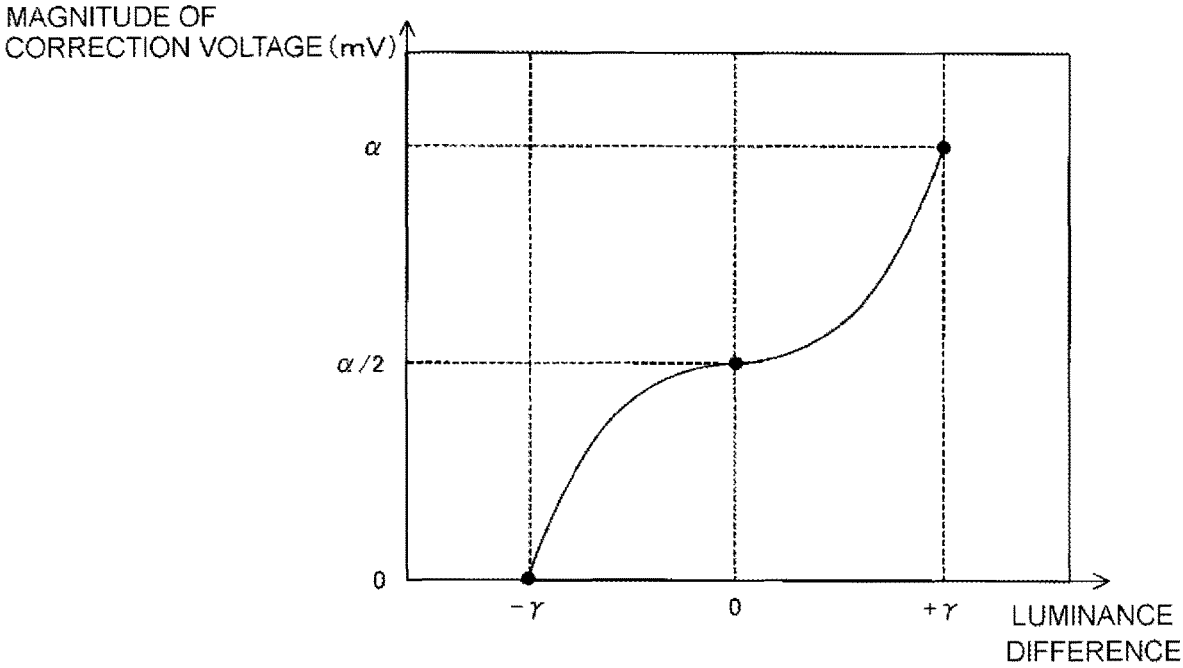
FIG. 11 is a graph showing the magnitude of correction voltage in relation to luminance difference.

FIG. 11 is a graph showing the magnitude of the correction voltage in relation to the luminance difference. In FIG. 11, the horizontal axis represents the luminance difference of the luminance value detected before varying the voltage of the counter electrode 21 with respect to the luminance value when varying the voltage of the counter electrode 21 by −α mV or +α mV, and the vertical axis represents the magnitude of the correction voltage (mV). This graph can be obtained by taking the luminance difference of the luminance value, on the horizontal axis, which is detected before varying the voltage of the counter electrode 21 with respect to the luminance value when varying the voltage of the counter electrode 21 by −α mV (or +α mV) and plotting the magnitude of the corresponding correction voltage based on the even function indicated by the graph in FIG. 8, when the deviation direction of the voltage of the counter electrode 21 is detected as the plus side (or the minus side). In the drawing, γ on the horizontal axis and α on the vertical axis take the same values as those described in FIG. 8.

For example, in a case where the deviation direction of the voltage of the counter electrode 21 is detected as the plus side, when the luminance difference of the luminance value detected before varying the voltage of the counter electrode 21 with respect to the luminance value when varying the voltage of the counter electrode 21 by −α mV is −γ, a point having coordinate values (−γ, 0) on the horizontal axis is referred to and the magnitude of the correction voltage is determined as 0 mV. When referring to FIG. 9A, this corresponds to a case where the point X1 is on the vertical axis and the luminance difference from the point Y1 is −γ, and there is no deviation in the voltage of the counter electrode 21.

Further, when the luminance difference of the luminance value detected before varying the voltage of the counter electrode 21 with respect to the luminance value when varying the voltage of the counter electrode 21 by −α mV is 0, a point having coordinate values (0, α/2) on the vertical axis is referred to and the magnitude of the correction voltage is determined as α/2 mV. When referring to FIG. 9B, this corresponds to a case where the point. X2 is positioned symmetrically to the point Y2 with respect to the vertical axis and the luminance difference from the point Y2 is 0, and the deviation in the voltage of the counter electrode 21 is a half of α.

Further, when the luminance difference of the luminance value detected before varying the voltage of the counter electrode 21 with respect to the luminance value when varying the voltage of the counter electrode 21 by −α mV is γ, a point having coordinate values (γ, α) is referred to and the magnitude of the correction voltage is determined as α mV. Referring to FIG. 9C, this corresponds to a case where the point Y3 is on the vertical axis and the luminance difference of the point X3 with respect to the point Y3 is γ, and the deviation in the voltage of the counter electrode 21 is α.

On the other hand, in a case where the deviation direction of the voltage of the counter electrode 21 is detected as the minus side, when the luminance difference of the luminance value detected before varying the voltage of the counter electrode 21 with respect to the luminance value when varying the voltage of the counter electrode 21 by +α mV is extremely close to −γ, a point having coordinate values extremely close to (−γ, 0) on the horizontal axis is referred to and the magnitude of the correction voltage is determined as a value extremely close to 0 my. Referring to FIG. 10A, this corresponds to a case where the point X4 is positioned extremely close to the vertical axis and the luminance difference from the point Z4 is extremely close to −γ, and the deviation in the voltage of the counter electrode 21 is extremely close to zero.

Further, when the luminance difference of the luminance value detected before varying the voltage of the counter electrode 21 with respect to the luminance value when varying the voltage of the counter electrode 21 by +α mV is 0, a point having coordinate values (0, α/2) on the vertical axis is referred to and the magnitude of the correction voltage is determined as α/2 mV. Accordingly, the correction voltage is determined as −α/2 mV. Referring to FIG. 10B, this corresponds to a case where the point X5 is positioned symmetrically to the point Z5 with respect to the vertical axis and the luminance difference from the point Z5 is 0, and the deviation in the voltage of the counter electrode 21 is a half of −α.

Further, when the luminance difference of the luminance value detected before varying the voltage of the counter electrode 21 with respect to the luminance value when varying the voltage of the counter electrode 21 by +α mV is γ, a point having coordinate values (γ, α) is referred to and the magnitude of the correction voltage is determined as a my. Accordingly, the correction voltage is determined as −α mV. Referring to FIG. 10C, this corresponds to a case where the point Z6 is on the vertical axis and the luminance difference of the point X6 with respect to the point Z6 is γ, and the deviation in the voltage of the counter electrode 21 is −α.

Figure 12:
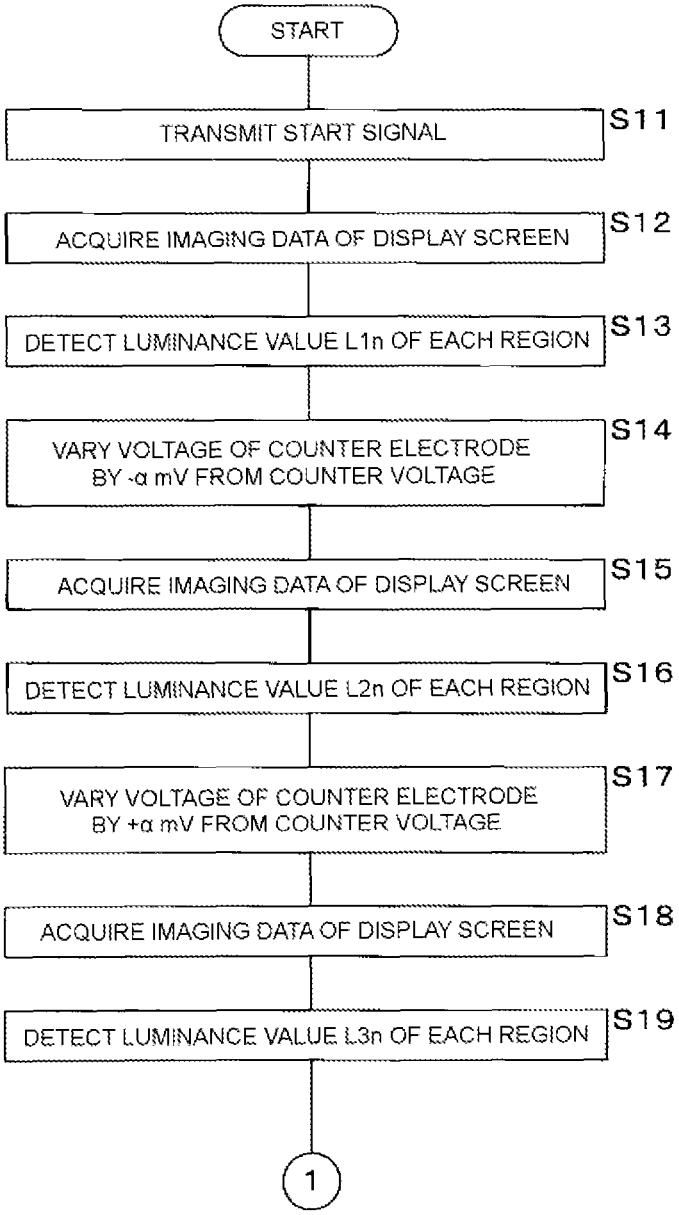
FIG. 12 is a flowchart showing a processing procedure of CPU that generates and transmits correction data indicating the correction voltage in the correction data generation device according to an embodiment of the present invention.
Figure 13:
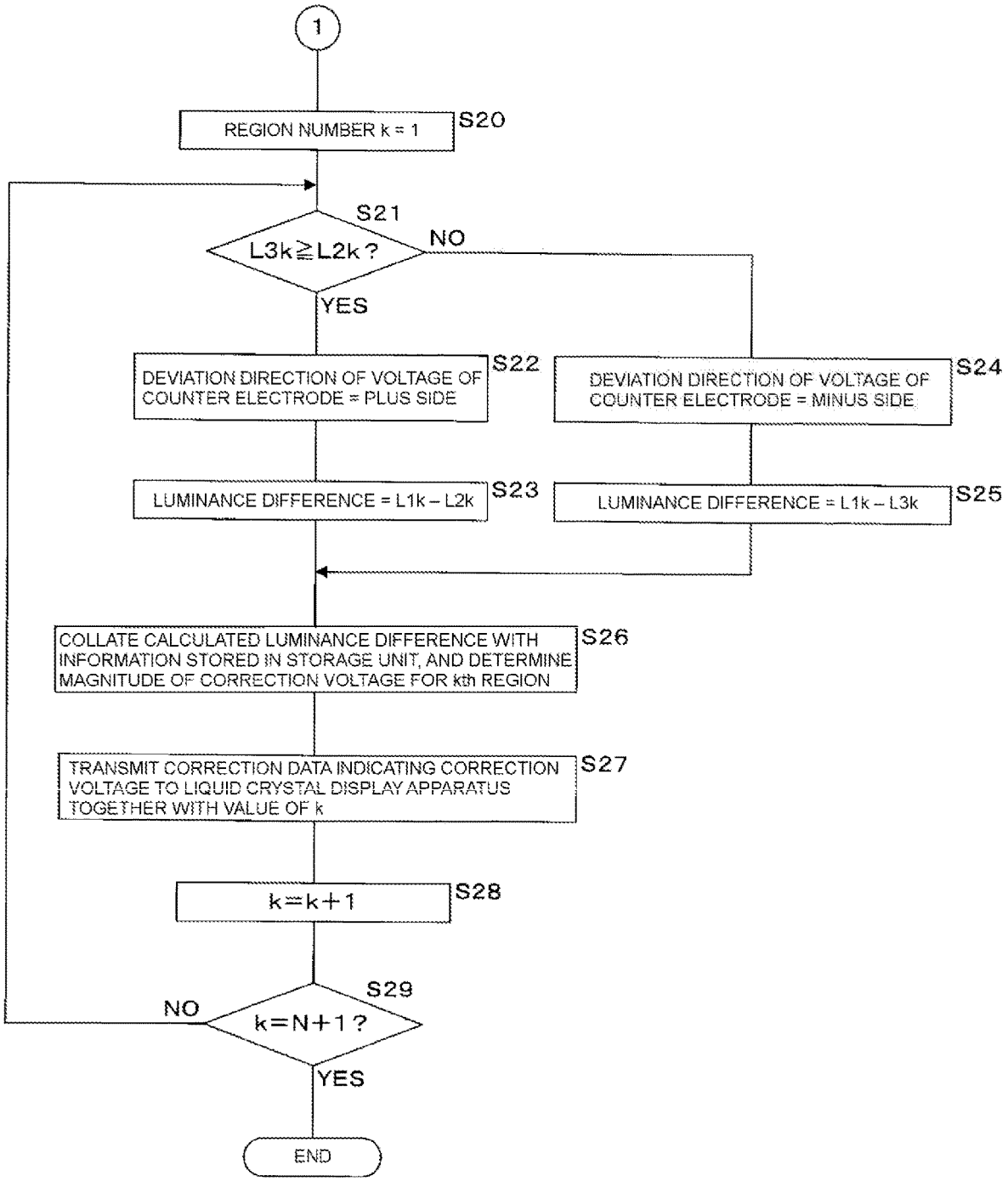
FIG. 13 is a flowchart showing a processing procedure of CPU that generates and transmits correction data indicating the correction voltage in the correction data generation device according to an embodiment of the present invention.
Figure 14:
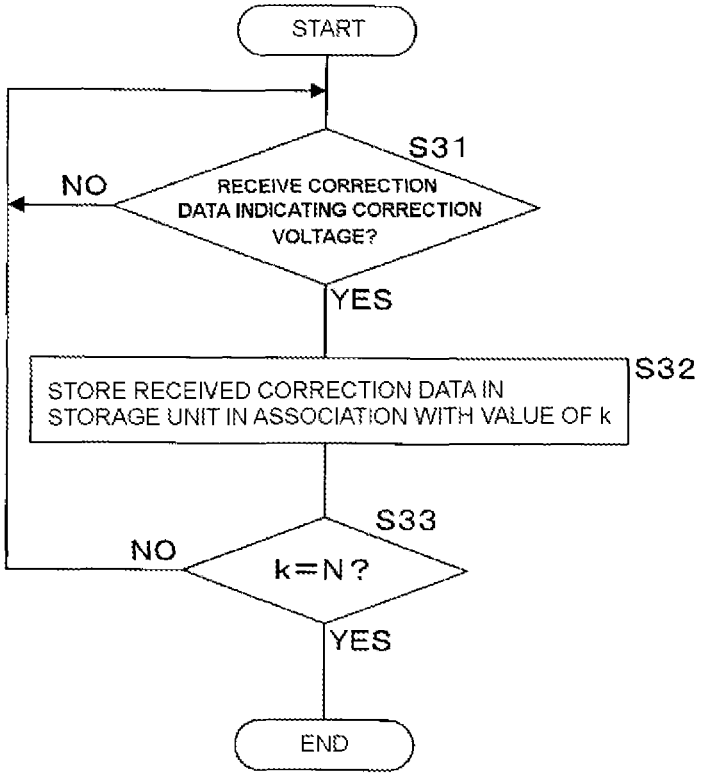
FIG. 14 is a flowchart showing a processing procedure of a signal input circuit that receives and stores the correction data indicating the correction voltage.
Figure 15:
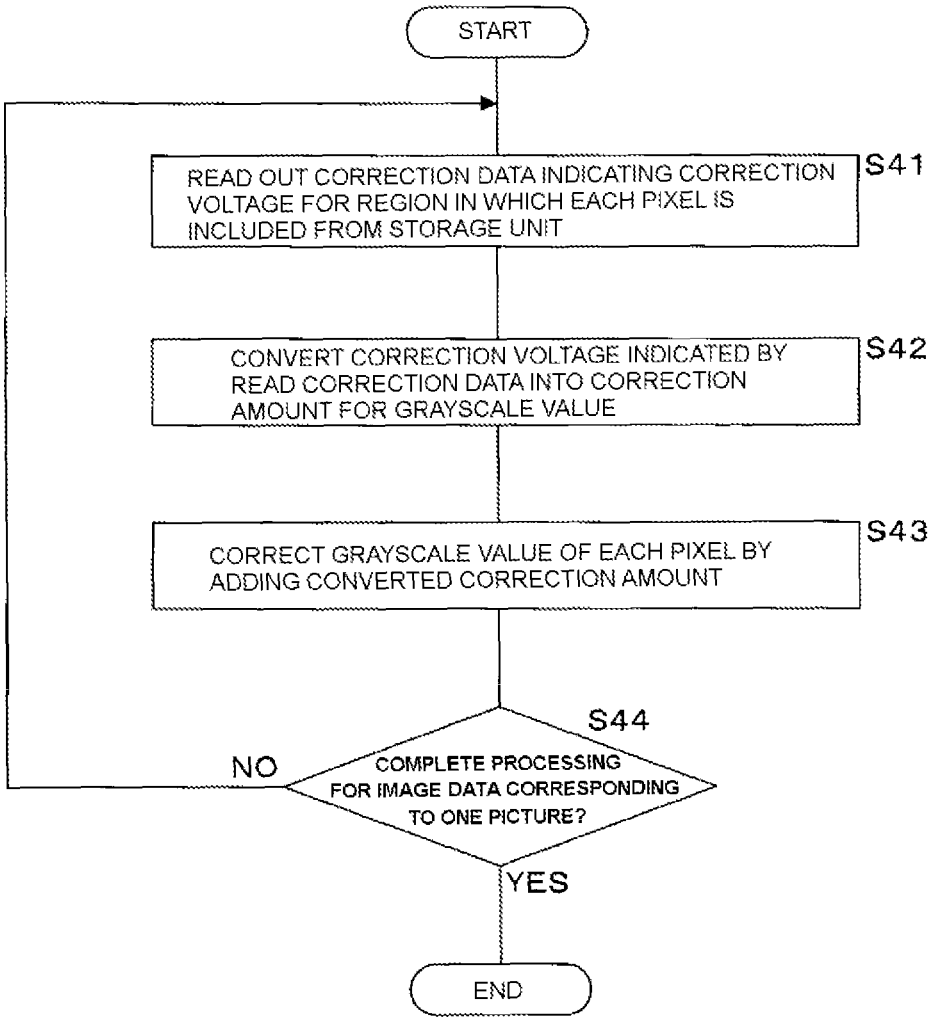
FIG. 15 is a flowchart showing a processing procedure of the signal input circuit that corrects grayscale value of each pixel.

Hereinafter, operations of the correction data generation device 5 and the liquid crystal display apparatus 1 described above will be described with reference to flowcharts that show the operations. FIGS. 12 and 13 are flowcharts showing processing procedures of the CPU 51 that generates and transmits correction data indicating the correction voltage in the correction data generation device 5 according to the embodiment of the present invention. FIG. 14 is a flowchart showing a processing procedure of the signal input circuit 40 that receives and stores the correction data indicating the correction voltage. Further, FIG. 15 is a flowchart showing a processing procedure of the signal input circuit 40 that corrects the grayscale value of each pixel P.

The processing shown in FIGS. 12 and 13 is activated, for example, when the CPU 51 receives an instruction from a user interface (not shown), and is executed by the CPU 51 according to the control programs stored in advance in the storage unit 52. The processing shown in FIG. 14 is started, for example, when a start signal from the correction data generation device 5 is received, and executed by a hardware circuit (not shown) included in the signal input circuit 40. The processing illustrated in FIG. 15 is started each time when an image signal for one picture is input to the liquid crystal display apparatus 1 separated from the correction data generation device 5, and executed by the above-mentioned hardware circuit of the signal input circuit 40.

Before the processing of FIG. 12 is activated, the image signal is adjusted in such a manner that a grayscale value included in image data to be separated from the image signal becomes a predetermined grayscale value, and the voltage of the counter electrode 21 is set to a specific counter voltage. Accordingly, the amplitude of the source signal to be applied to all the TFTs 15 is fixed to a uniform amplitude corresponding to the predetermined grayscale value, and the voltage of the counter electrode 21 is set, for example, to an intermediate voltage among the optimum counter voltages of respective regions of the display screen. The amplitude of the source signal may be set to be uniform irrespective of the image signal. The camera 6 constantly images the display screen of the liquid crystal display apparatus 1 and outputs imaging data at a constant frame rate. The information indicating the relationship between the luminance difference and the magnitude of the correction voltage shown in FIG. 11 is stored in the storage unit 52.

In order to specify the optimum counter voltage for one region of interest, for example, while varying the voltage setting data, in stages by using an adjustment program, to be transmitted from the correction data generation device 5 to the liquid crystal display apparatus 1, a user may specify a case where the one region is visually recognized as the darkest one or a case where the flicker of the one region is visually recognized as the smallest one. The voltage being applied to the counter electrode 21 when the case is specified is the optimum counter voltage for the above-mentioned one region. In the present embodiment, an intermediate voltage between the highest voltage and the lowest voltage among the optimum counter voltages specified for all the regions is set beforehand so as to be applied to the counter electrode 21.

When the processing shown in FIG. 12 is activated after the above-mentioned preprocessing, the CPU 51 first transmits the start signal to the liquid crystal display apparatus 1 (S11), and activates the processing shown in FIG. 14. Next, the CPU 51 acquires imaging data of the display screen from the camera 6 (S12: corresponding to a first acquisition unit), and individually detects luminance value L1*n* (n is an integer from 1 to N) of each of N regions (N is an integer equal to or greater than 2), i.e., first to Nth regions, in an image represented by the acquired imaging data (S13: corresponding to a detection unit).

Here, it is assumed that one or more pixels P are included in each of the first to the Nth regions. In a case where one pixel P is included in each region, the luminance value L1*n* of each region is the luminance value of the one pixel P itself included in respective region. On the other hand, in a case where a plurality of pixels P is included in each region, the luminance value L1*n* of each region is an average of luminance values (corresponding to an average luminance) of the plurality of pixels P included in respective region. The average value is not limited to an arithmetic mean and can be, for example, a statistical value such as a median value, a mode value or a representative value representing the luminance value of each pixel P.

Further, the imaging data to be acquired in step S12 may correspond to one frame or may correspond to a plurality of frames. For example, the luminance value L1*n* of each region in the case of acquiring the imaging data of a plurality of frames may be a statistical value such as an average value, a median value, or a mode value for the luminance value of each region in each frame.

The luminance value L1*n* detected in step S13 reflects each of the result influenced by a reduction of the effective voltage due to the deviation in the voltage of the counter electrode 21 described with reference to FIG. 4, the result influenced by a reduction of the effective voltage due to reduction in the amplitude of the pixel signal described with reference to FIG. 5, and the result influenced by other defects.

Then, the CPU 51 varies the voltage setting data and transmits it to the liquid crystal display apparatus 1, thereby varying the voltage of the counter electrode 21 by $-\alpha$ mV from the above-mentioned counter voltage (S14). Next, the CPU 51 newly acquires imaging data of the display screen from the camera 6 (S15: corresponding to a third acquisition unit), and individually detects luminance value L2*n* for each of N regions in an image represented by the acquired imaging data (S16: corresponding to the detection unit).

Then, the CPU 51 varies the voltage setting data in the opposite direction to the previous variation and transmits it to the liquid crystal display apparatus 1, thereby varying the voltage of the counter electrode 21 by $+\alpha$ mV from the above-mentioned counter voltage (S17). Next, the CPU 51 newly acquires imaging data of the display screen from the camera 6 (S18: corresponding to a second acquisition unit), and individually detects luminance value L3*n* for each of N regions in an image represented by the acquired imaging data (S19: corresponding to the detection unit).

Next, the CPU 51 sets an initial value of region number k for identifying each region to 1 (S20) and subsequently determines whether a previously detected L3*k* is equal to or greater than L2*k* (S21). This corresponds to the determining whether the above-mentioned formula (5) holds or not. When L3*k* is equal to or greater than L2*k* (S21: YES), that is, when the formula (5) holds, the CPU 51 detects the deviation direction of the voltage of the counter electrode 21 in a kth region as the plus side based on the matters in FIGS. 9A, 9B, and 9C (522). Accordingly, the polarity of the correction voltage is determined as plus. Next, the CPU 51 calculates the luminance difference in the kth region as "L1*k*-L2*k*" based on the formula (7) (S23). As mentioned above, even when there is no deviation in the voltage of the counter electrode 21, the deviation direction is detected as the plus side, for convenience, and the magnitude of the correction voltage is determined as 0 mV in step S26 as described below.

On the other hand, when L3*k* is not L2*k* or more in step S21 (S21: NO), namely when the formula (6) holds, the CPU 51 detects the deviation direction of the voltage of the counter electrode 21 in the kth region as the minus side based on the matters in FIGS. 10A, 10B, and 10C (S24). Accordingly, the polarity of the correction voltage is determined as minus. Next, the CPU 51 calculates the luminance difference in the kth region as "L1*k*-L3*k*" based on the formula (8) (S25).

After completing the processing of step S23 or S25, the CPU 51 collates the calculated luminance difference with the information stored in the storage unit 52 and determines the magnitude of a correction voltage for the kth region (S26). Then, the CPU 51 transmits correction data indicating the correction voltage generated by determining the polarity and the magnitude (corresponding to a generation unit) to the liquid crystal display apparatus 1 together with the value of the region number k (S27). Next, the CPU 51 increments k by 1 (S28) and determines whether k is N+1 (S29).

When k is not N+1 (S20: NO), the processing by the CPU 51 proceeds to step S21 to determine a correction voltage for another region and transmits correction data indicating the correction voltage to the liquid crystal display apparatus 1. On the other hand, when k is N+1 (S29: YES), the CPU 51 terminates the sequential processing shown in FIGS. 12 and 13. Through the sequential processing, the polarity and the magnitude of the correction voltage are determined for each region, and information indicating the determined results is transmitted to the liquid crystal display apparatus 1. The correction data may not be transmitted but be stored at step S27, and the stored correction data may be collectively transmitted when terminating the sequential processing (S29: YES) after completing the storage of the correction data for all regions.

When the processing shown in FIG. 14 is started after the liquid crystal display apparatus 1 receives the start signal from the correction data generation device 5, the signal input circuit 40 determines whether the correction data indicating the correction voltage has been received. (S31). When no correction data is received (S31: NO), the signal input circuit 40 waits until reception. When the correction data indicating the correction voltage has been received (S31: YES), the signal input circuit 40 stores the received correction data in the storage unit 401 in association with the received value of k (S32). The correction data stored in the storage unit 401 can be the data obtained by converting the data indicating the correction voltage into data indicating a correction amount of the grayscale value.

Then, the signal input circuit 40 determines whether the received k is N, namely the correction data indicating the correction voltage has been received for all regions (S33). When k is not N (S33: NO), the processing proceeds to step S31. On the other hand, when k is N (S33: YES), the signal input circuit 40 terminates the sequential processing shown in FIG. 14. Through the sequential processing, the correction data determined beforehand by the correction data generation device 5 and indicating the correction voltage for each region is stored in the storage unit 401 in association with the region number.

Next, when the processing shown in FIG. 15 is started in a state where the liquid crystal display apparatus 1 is separated from the correction data generation device 5, the signal input circuit 40 corrects the grayscale value of the pixel P included in the image data based on the contents stored in the storage unit 401 according to the following procedure. Here, it is assumed that the correspondence between the region number and the display position in the row direction and the column direction of the pixel P included in the region indicated by each region number is stored beforehand in the source signal control circuit 41.

The signal input circuit 40 reads the correction data indicating the correction voltage for a region in which each pixel P is included from the storage unit 401 (S41), and converts the correction voltage indicated by the readout correction data into a correction amount of the grayscale value based on, for example, a table (not shown) (S42). Next, the signal input circuit 40 adds the converted correction amount of the grayscale value to a grayscale value of each pixel P and corrects the grayscale value (S43). When the correction data stored in the storage unit 401 is the data indicating the correction amount of the grayscale value, the grayscale value indicated by the correction data may be added to the grayscale value of each pixel P.

As mentioned above, the corrected grayscale value is gamma-corrected by the source signal control circuit 41 and is provided to the source driver SD. The source driver SD performs D/A conversion on the grayscale correction value from the source signal control circuit 41 and generates a source signal on which the correction voltage is superimposed. The generated source signal is applied to the TFT 15 via the source signal line SL.

On the other hand, the signal input circuit 40 determines whether the processing for the image data corresponding to one picture has been completed (S44). If the processing is not completed (S44: NO), the processing proceeds to step S41. On the other hand, if the processing is completed (S44: YES), the signal input circuit 40 terminates the sequential processing shown in FIG. 15. Through the sequential processing and the D/A conversion by the source driver SD described above, the correction voltage is superimposed on the source signal of each region.

In the flowchart shown in FIG. 15, irrespective of the grayscale value of the pixel P included in the image data, the correction voltage is determined and superimposed on the source signal, however, the correction voltage may be changed according to the grayscale value. More specifically, for example, the processing shown in FIGS. 12 and 13 may be repetitively performed for grayscale values of the numbers 1 to M (M is an integer equal to or greater than 2) each having magnitude different to each other. And in step S32 of the processing shown in FIG. 14, the correction data may be stored in the storage unit 401 in association with a grayscale value number and the region number. Then, in step S42 of the processing shown in FIG. 15, the grayscale value number that fits the grayscale value before gamma correction may be specified by interpolation, and the correction data may be read out from the storage unit 401 according to the specified grayscale value number and the region number.

As mentioned above, according to the present embodiment, in the luminance nonuniformity correction, in a state where the amplitude of the source signal is set to the amplitude corresponding to the predetermined grayscale value and the voltage of the counter electrode 21 is set to the specific counter voltage, an image of the display screen is captured by the camera 6 and the luminance value L1*n* (n is an integer from 1 to N) for each region is detected. Further, the voltage of the counter electrode 21 is varied from the specific counter voltage by $-\alpha$ mV and $+\alpha$ mV respectively, and each e the voltage of the counter electrode is varied, an image of the display screen is captured by the camera 6 to detect the luminance values L2*n* and L3*n* for each region. Then, based on the luminance value the luminance value L2*n*, and the luminance L3*n*, the correction voltage for correcting the deviation between the voltage of the counter electrode 21 to be originally set and the specific counter voltage being actually set is determined for each region. The determined correction voltage is superimposed on the source signal corresponding to the grayscale value.

Accordingly, for a region where there is a deviation between the voltage of the counter electrode 21 to be respectively set for the signal written to the pixel electrode 11 in each region and the specific counter voltage, the correction voltage that can cancel out the deviation is superimposed on the source signal. Accordingly, it becomes possible to correct the luminance nonuniformity even when the optimum counter voltage varies depending on a region of the display screen. Further, by using the correction voltage to correct the luminance nonuniformity in each region caused by a plurality of factors, it is possible to correct the luminance nonuniformity regardless of the factors of the luminance nonuniformity in each region.

Further, according to the present embodiment, the polarity of the correction voltage is determined based on the magnitude relationship between the luminance value L2*n* and the luminance value L3*n* each detected when varying the voltage of the counter electrode 21 from the specific counter voltage by −α mV and +α mV, respectively. Accordingly, by detecting the direction of the deviation between the voltage of the counter electrode 21 to be originally set and the specific counter voltage, it is possible to determine the polarity of the correction voltage that can cancel out the deviation.

Further, according to the present embodiment, based on the change amount of any one of the luminance value L2*n* and luminance value L3*n* each detected when varying the voltage of the counter electrode 21 by −α mV and +α mV, respectively, with respect to the luminance value L1*n* detected when the voltage of the counter electrode 21 is the specific counter voltage, the magnitude of the correction voltage for correcting the deviation in the voltage of the counter electrode 21 is determined. Accordingly, since the polarity and the magnitude of the correction voltage are determined, it is possible to uniquely determine the correction voltage.

Further, according to the present embodiment, the information indicating the relationship between the amount of the deviation of the specific counter voltage being actually set with respect to the voltage of the counter electrode 21 to be originally set and the change amount of the luminance value of the pixel P when varying the voltage of the counter electrode 21 from the specific counter voltage by −α my or +α mV is stored in the storage unit 52. By collating the change amount of the luminance value L2*n* or L3*n* each detected when varying the voltage of the counter electrode 21 from the specific counter voltage by −α mV or +α mV with respect to the luminance value L1*n* detected when the voltage of the counter electrode 21 is the specific counter voltage with the information stored in the storage unit 52, the magnitude of the deviation in the voltage of the counter electrode 21 is detected. Accordingly, it is possible to easily determine the magnitude of the correction voltage that can cancel out the deviation.

Further, according to the present embodiment, one or more pixels P are included in each region. When one pixel P is included in the region, the luminance value of the pixel P is the luminance value of the region. When a plurality of pixels P is included in the region, the average luminance value of the plurality of pixels P is the luminance value of the region. Accordingly, it is possible to arbitrarily set the range of a region in which the correction voltage is superimposed on the source signal.

Further, according to the present embodiment, among the intermediate voltages of the signals which are written to the pixel electrodes 11 in each of the regions, an intermediate voltage between the highest and the lowest voltage of all the regions is set as the specific counter voltage. Accordingly, when varying the voltage of the counter electrode 21 by −α mV and +α mV with the specific counter voltage as the center; the possibility that the luminance value of each region varies beyond the minimal value becomes higher, and it is possible to reduce an error included in the magnitude of the correction voltage.

Further, according to the present embodiment, the correction data indicating the correction voltage determined beforehand for each region is stored in the storage unit 401 in association with the region number. The value of the correction data indicating the correction voltage for each region is read out from the storage unit 401. A correction voltage corresponding to the readout correction data is superimposed on the source signal generated by performing gamma correction and D/A conversion on the grayscale value of the pixel P in respective region. Accordingly, even when the camera 6 is not present, it is possible to correct the deviation in the voltage of the counter electrode 21 for each region by the liquid crystal display apparatus 1 alone.

Further, according to the present embodiment, in the generation of the correction data indicating the correction voltage, the imaging data of the display screen captured by the camera 6 when the amplitude of the source signal is the amplitude corresponding to the predetermined grayscale value and the voltage of the counter electrode 21 is the specific counter voltage is acquired by the first acquisition unit and the luminance value L1*n* for each region is detected. Further, the imaging data of the display screen each captured when the voltage of the counter electrode 21 varies from the specific counter voltage by −α mV and +α mV, respectively, are acquired by the third and second acquisition units, and the luminance value L2*n* and luminance value L3*n* for each region are detected. Then, based on the luminance values L1*n*, L2*n*, and L3*n*, the correction data indicating the correction voltage for correcting the deviation between the voltage of the counter electrode 21 to be originally set and the specific counter voltage being actually set is generated for each region. Accordingly, it is possible to indicate the correction voltage, by the generated correction data, for a region where there is a deviation between the voltage of the counter electrode 21 to be respectively set for the signal written to the pixel electrode 11 in each region and the specific counter voltage. The correction voltage is superimposed on the source signal so as to cancel out the deviation.

Although the case of using the normally black type liquid crystal panel 100 has been described in the present embodiment, a normally white type liquid crystal panel may also be used. In this case, the luminance nonuniformity shown in the lower part of FIG. 6 alters in such a manner that an image is displayed on the screen relatively dark at the end of the panel. Further, the V-T characteristics in FIG. 7 alters in such a way as to draw curves downward-sloping to the right by the solid line and the dotted line. Each of the graphs shown in FIGS. 8, 9A, 9B, 9C, 10A, 10B, and 10C alters in such a way as to draw an upward convex curve having a maximal value. Accordingly, it is necessary to invert all the signs of inequality in respective formulae (3) to (6). The signs (plus/minus) of the luminance differences calculated by the formulae (7) and (8) become opposite to the signs in the present embodiment. Therefore, the graph shown FIG. 11 alters in such a manner that the right and left sides are reversed with the line indicating the luminance difference of 0 as the center. Further, in step S21 shown in FIG. 13, the branch destinations according to the determination of "YES/NO" are reversed. The remaining drawings, flowcharts, and description contents are similar to those in the present embodiment.

DESCRIPTION OF REFERENCE NUMERAL

1: Liquid crystal display apparatus
100: Liquid crystal panel
11: Pixel electrode
12: Auxiliary capacitance electrode
15: TFT
21: Counter electrode
22: Auxiliary capacitance counter electrode
3: Liquid crystal layer
4: Display control circuit
40: Signal input circuit
401: Storage unit

41: Source signal control circuit
42: Scanning signal control circuit
43: Counter voltage application circuit
P, Pn: Pixel
Clc: Liquid crystal capacitance
Ccs: Auxiliary capacitance
Gn: Scanning signal line
GD: Gate driver
SD: Source driver
SL: Source signal line
5: Correction data generation device
51: CPU
52: Storage unit
53: Input unit
54: Communication unit
6: Camera

The invention claimed is:

1. A luminance nonuniformity correction method for correcting luminance nonuniformity occurring on a display screen of a liquid crystal display apparatus in which pixels each being defined so as to include a pixel electrode and a counter electrode facing each other via a liquid crystal layer are arranged in a matrix form and a data signal having an amplitude corresponding to a grayscale value from the outside is applied to a switching element to provide a signal to the pixel electrode, comprising:

preparing an imaging unit configured to capture an image of the display screen;

setting an amplitude of the data signal to an amplitude corresponding to a predetermined grayscale value;

setting a voltage of the counter electrode to a specific counter voltage;

capturing an image of the display screen with the imaging unit;

capturing each image of the display screen with the imaging unit while increasing and decreasing a voltage of the counter electrode, respectively, by a predetermined voltage;

detecting a luminance value for each of a plurality of regions of the display screen each time an image is captured;

determining a correction voltage for each of the regions, for correcting a deviation between a voltage of the counter electrode to be set for the signal provided to the pixel electrode and the counter voltage, based on a luminance value detected without increasing and decreasing a voltage of the counter electrode and luminance values each detected while increasing and decreasing a voltage of the counter electrode, respectively; and superimposing a determined correction voltage on the data signal having an amplitude corresponding to a grayscale value from the outside.

2. The luminance nonuniformity correction method for a liquid crystal display apparatus according to claim 1, comprising:

comparing luminance values each detected while increasing and decreasing a voltage of the counter electrode, respectively; and determining a polarity of the correction voltage based on a comparison result.

3. The luminance nonuniformity correction method for a liquid crystal display apparatus according to claim 2, comprising:

calculating a change amount of any one of luminance values each detected while increasing and decreasing a voltage of the counter electrode, respectively, with respect to a luminance value detected without increasing and decreasing the voltage of the counter electrode; and determining a magnitude of the correction voltage based on a calculation result.

4. The luminance nonuniformity correction method for a liquid crystal display apparatus according to claim 3, comprising:

preparing a first storage unit;

storing information in the first storage unit in advance, the information indicating a relationship between an amount of the deviation and an amount of a variation in a luminance value of the pixel when varying a voltage of the counter electrode from the counter voltage by a predetermined voltage; and determining a magnitude of the correction voltage based on the change amount and the information stored in the first storage unit.

5. The luminance nonuniformity correction method for a liquid crystal display apparatus according to claim 1, wherein one or more pixels are included in the region, and a luminance value of a region in which a plurality of pixels is included is an average luminance value of the plurality of pixels.

6. The luminance nonuniformity correction method for a liquid crystal display apparatus according to claim 1, wherein the counter voltage is an intermediate voltage between the highest voltage and the lowest voltage among intermediate voltages of signals each provided to a pixel electrode of a pixel included in each of the regions.

7. The luminance nonuniformity correction method for a liquid crystal display apparatus according to claim 1, comprising:

preparing a second storage unit;

storing a correction voltage determined in advance for each region in the second storage unit in association with the region;

reading out a correction voltage for each region from the second storage unit; and superimposing a readout correction voltage on the data signal having an amplitude corresponding to a grayscale value from the outside.

8. A correction data generation device to generate correction data for correcting luminance nonuniformity occurring on a display screen of a liquid crystal display apparatus in which pixels each being defined so as to include a pixel electrode and a counter electrode facing each other via a liquid crystal layer are arranged in a matrix form and a data signal having an amplitude corresponding to a grayscale value from the outside is applied to a switching element to provide a signal to the pixel electrode, comprising a central processing unit to:

acquire a first imaging data capturing an image of the display screen when the grayscale value is a predetermined grayscale value and a voltage of the counter electrode is a specific counter voltage;

acquire a second and a third imaging data capturing an image of the display screen when a voltage of the counter electrode increases and decreases from the counter voltage by a predetermined voltage, respectively;

detect a luminance value for each of a plurality of regions of the display screen based on the first, second and third imaging data acquired, respectively; and generate correction data for each of the region, the correction data indicating a correction voltage for correcting a deviation between a voltage of the counter electrode to be set for the signal provided to the pixel electrode and the counter voltage, based on a luminance value detected based on the first imaging data acquired and a luminance value detected based on the second and the third imaging data acquired, respectively.

* * * * *